US011196180B2

(12) United States Patent
Jo et al.

(10) Patent No.: US 11,196,180 B2
(45) Date of Patent: Dec. 7, 2021

(54) ANTENNA MODULE COMPRISING DIPOLE ANTENNA AND ELECTRONIC DEVICE COMPRISING THE SAME

(71) Applicant: Samsung Electronics Co., Ltd., Suwon-si (KR)

(72) Inventors: Jaehoon Jo, Suwon-si (KR); Dongyeon Kim, Suwon-si (KR); Hosaeng Kim, Suwon-si (KR); Seongjin Park, Suwon-si (KR); Taeyoon Seo, Suwon-si (KR); Sumin Yun, Suwon-si (KR); Myunghun Jeong, Suwon-si (KR); Jinwoo Jung, Suwon-si (KR); Jaebong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 4 days.

(21) Appl. No.: 16/927,165

(22) Filed: Jul. 13, 2020

(65) Prior Publication Data

US 2021/0013631 A1 Jan. 14, 2021

(30) Foreign Application Priority Data

Jul. 11, 2019 (KR) ..... 10-2019-0083632

(51) Int. Cl.
*H01Q 9/28* (2006.01)
*H01Q 21/26* (2006.01)
(Continued)

(52) U.S. Cl.
CPC ..... *H01Q 21/26* (2013.01); *H01Q 1/38* (2013.01); *H01Q 1/48* (2013.01)

(58) Field of Classification Search
CPC . H01Q 21/24–21/29; H01Q 1/24–1/48; H01Q 9/285
See application file for complete search history.

(56) References Cited

U.S. PATENT DOCUMENTS 6,339,406 B1 1/2002 Nesic et al.
6,342,867 B1 1/2002 Bell
(Continued)

OTHER PUBLICATIONS

International Search Report dated Nov. 13, 2020, issued in International Application No. PCT/KR2020/009216.

*Primary Examiner* — Hasan Islam
(74) *Attorney, Agent, or Firm* — Jefferson IP Law, LLP

(57) ABSTRACT

An electronic device including an antenna is provided. The electronic device includes a housing that includes a first plate, a second plate facing away from the first plate, and a side member surrounding a space between the first plate and the second plate, the side member being coupled to the second plate or integrally formed with the second plate, a printed circuit board that is disposed in the space and includes a first conductive layer, a second conductive layer, a third conductive layer, and a ground, and an antenna structure that is disposed in the space. The antenna structure includes a first conductive pattern that is formed at the first conductive layer and is electrically connected with a first feeding line, a second conductive pattern that is formed at the second conductive layer interposed between the first conductive layer and the third conductive layer and is electrically connected with the ground, and a third conductive pattern that is formed at the third conductive layer and is electrically connected with a second feeding line. The first conductive pattern includes a first conductive line extended in a first direction parallel to the first conductive layer, and a first radiation part extended from the first conductive line in a second direction making a first angle between 0 to −90 degrees with the first direction. The third conductive pattern includes a second conductive line extended in the first direction, and a second radiation part extended from the second conductive line in a third direction making a second angle between 0 to +90 degrees with the first direction. The
(Continued)

second conductive pattern includes a portion electrically connected with the ground, a third conductive line extended from the portion in the first direction, a third radiation part extended from the third conductive line in a fourth direction facing away from the second direction, a fourth conductive line spaced from the third conductive line and extended from the portion in the first direction, and a fourth radiation part extended from the fourth conductive line in a fifth direction facing away from the third direction.

20 Claims, 27 Drawing Sheets

(51) Int. Cl.
*H01Q 1/38* (2006.01)
*H01Q 1/48* (2006.01)

(56) References Cited

U.S. PATENT DOCUMENTS

| | | | | |
|---|---|---|---|---|
| 7,595,766 | B2 | 9/2009 | Rofougaran | |
| 9,276,323 | B2 * | 3/2016 | Moon | H01Q 5/48 |
| 9,484,634 | B1 * | 11/2016 | Behroozi | H01Q 9/40 |
| 9,570,809 | B2 | 2/2017 | Ganchrow et al. | |
| 10,153,556 | B2 | 12/2018 | Ganchrow et al. | |
| 10,305,171 | B1 * | 5/2019 | Navarro | H01Q 1/243 |
| 2004/0036655 | A1 * | 2/2004 | Sainati | H01Q 9/285 343/702 |
| 2009/0016417 | A1 | 1/2009 | Rofougaran | |
| 2011/0090131 | A1 | 4/2011 | Chen et al. | |
| 2013/0171951 | A1 | 7/2013 | Li et al. | |

* cited by examiner

ANTENNA MODULE COMPRISING DIPOLE ANTENNA AND ELECTRONIC DEVICE COMPRISING THE SAME

CROSS-REFERENCE TO RELATED APPLICATION(S)

This application is based on and claims priority under 35 U.S.C. § 119 of a Korean patent application number 10-2019-0083632, filed on Jul. 11, 2019, in the Korean Intellectual Property Office, the disclosure of which is incorporated by reference herein in its entirety.

BACKGROUND

1. Field

The disclosure relates to an antenna module including a dipole antenna and an electronic device including the same.

2. Description of Related Art

To satisfy a demand on a wireless data traffic increasing after commercialization of a 4th generation (4G) communication system, there is a study of a 5th generation (5G) communication system capable of transmitting/receiving a signal in a high-frequency band. To perform wireless communication at the 5G communication system, an antenna module may include an antenna structure configured to radiate a signal in a high-frequency band.

The above information is presented as background information only to assist with an understanding of the disclosure. No determination has been made, and no assertion is made, as to whether any of the above might be applicable as prior art with regard to the disclosure.

SUMMARY

An antenna structure may include various kinds of antennas, and each of the antennas of the different kinds may include at least one antenna that is determined depending on a beam pattern, a radiation pattern, directivity, a gain, a beam width, or a polarization. For example, in the 5G communication system, the antenna structure may be implemented with a patch antenna, a dipole antenna, or a combination thereof. The dipole antenna may form a wider beam (or coverage) than the patch antenna, but it may be difficult to implement a dipole antenna of a dual polarization characteristic at an antenna structure having no space.

Aspects of the disclosure are to address at least the above-mentioned problems and/or disadvantages and to provide at least the advantages described below. Accordingly, an aspect of the disclosure is to provide an antenna module including a dipole antenna having a dual polarization characteristic and a structure thereof.

Additional aspects will be set forth in part in the description which follows and, in part, will be apparent from the description, or may be learned by practice of the presented embodiments.

In accordance with an aspect of the disclosure, an electronic device is provided. The electronic device includes a housing that includes a first plate, a second plate facing away from the first plate, and a side member surrounding a space between the first plate and the second plate, the side member being coupled to the second plate or integrally formed with the second plate, a printed circuit board that is disposed in the space and includes a first conductive layer, a second conductive layer, a third conductive layer, and a ground, and an antenna structure that is disposed in the space. The antenna structure may include a first conductive pattern that is formed at the first conductive layer and is electrically connected with a first feeding line, a second conductive pattern that is formed at the second conductive layer interposed between the first conductive layer and the third conductive layer and is electrically connected with the ground, and a third conductive pattern that is formed at the third conductive layer and is electrically connected with a second feeding line. The first conductive pattern may include a first conductive line extended in a first direction parallel to the first conductive layer, and a first radiation part extended from the first conductive line in a second direction making a first angle between 0 to −90 degrees with the first direction. The third conductive pattern may include a second conductive line extended in the first direction, and a second radiation part extended from the second conductive line in a third direction making a second angle between 0 to +90 degrees with the first direction. The second conductive pattern may include a portion electrically connected with the ground, a third conductive line extended from the portion in the first direction, a third radiation part extended from the third conductive line in a fourth direction facing away from the second direction, a fourth conductive line spaced from the third conductive line and extended from the portion in the first direction, and a fourth radiation part extended from the fourth conductive line in a fifth direction facing away from the third direction.

In accordance with another aspect of the disclosure, an electronic device is provided. The electronic device includes a housing that includes a first plate, a second plate facing away from the first plate, and a side member surrounding a space between the first plate and the second plate, the side member being coupled to the second plate or integrally formed with the second plate, a printed circuit board that is disposed in the space and includes a first conductive layer, a second conductive layer, a third conductive layer, and a ground, and an antenna structure that is disposed in the space. The antenna structure may include a first conductive pattern that is formed at the first conductive layer and is electrically connected with a first feeding line, a second conductive pattern that is formed at the first conductive layer and is electrically connected with a second feeding line, a third conductive pattern that is formed at the second conductive layer interposed between the first conductive layer and the third conductive layer and is electrically connected with the ground, a fourth conductive pattern that is formed at the third conductive layer and is electrically connected with a third feeding line, and a fifth conductive pattern that is formed at the third conductive layer and is electrically connected with a fourth feeding line. The first conductive pattern may include a first conductive line extended in a first direction parallel to the first conductive layer, and a first radiation part extended from the first conductive line in a second direction making a first angle between 0 to −90 degrees with the first direction. The second conductive pattern may include a second conductive line extended substantially in parallel with the first conductive layer, and a second radiation part extended from the second conductive line in a third direction making a second angle between −90 to −180 degrees with the first direction. The third conductive pattern may be extended in the first direction. The fourth conductive pattern may include a third conductive line extended in the first direction, and a third radiation part extended from the third conductive line in a direction facing away from the second direction. The fifth conductive pattern may include a fourth conductive line extended in the first direction, and a fourth radiation part extended from the fourth conductive line in a direction facing away from the third direction.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
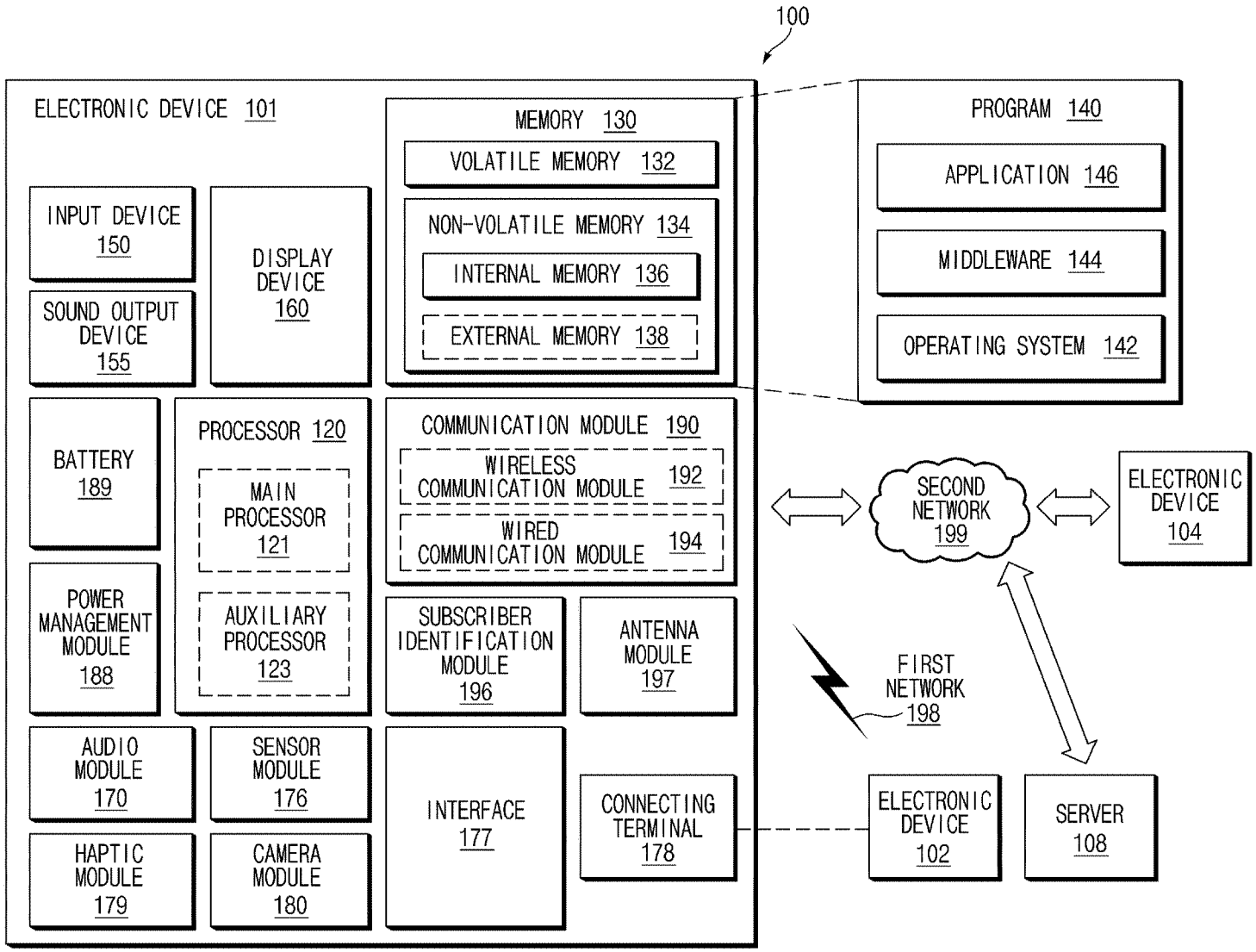
FIG. 1 is a block diagram of an electronic device in a network environment according to an embodiment of the disclosure.

FIG. 1 is a block diagram illustrating an electronic device 101 in a network environment 100 according to an embodiment of the disclosure.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) there between via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
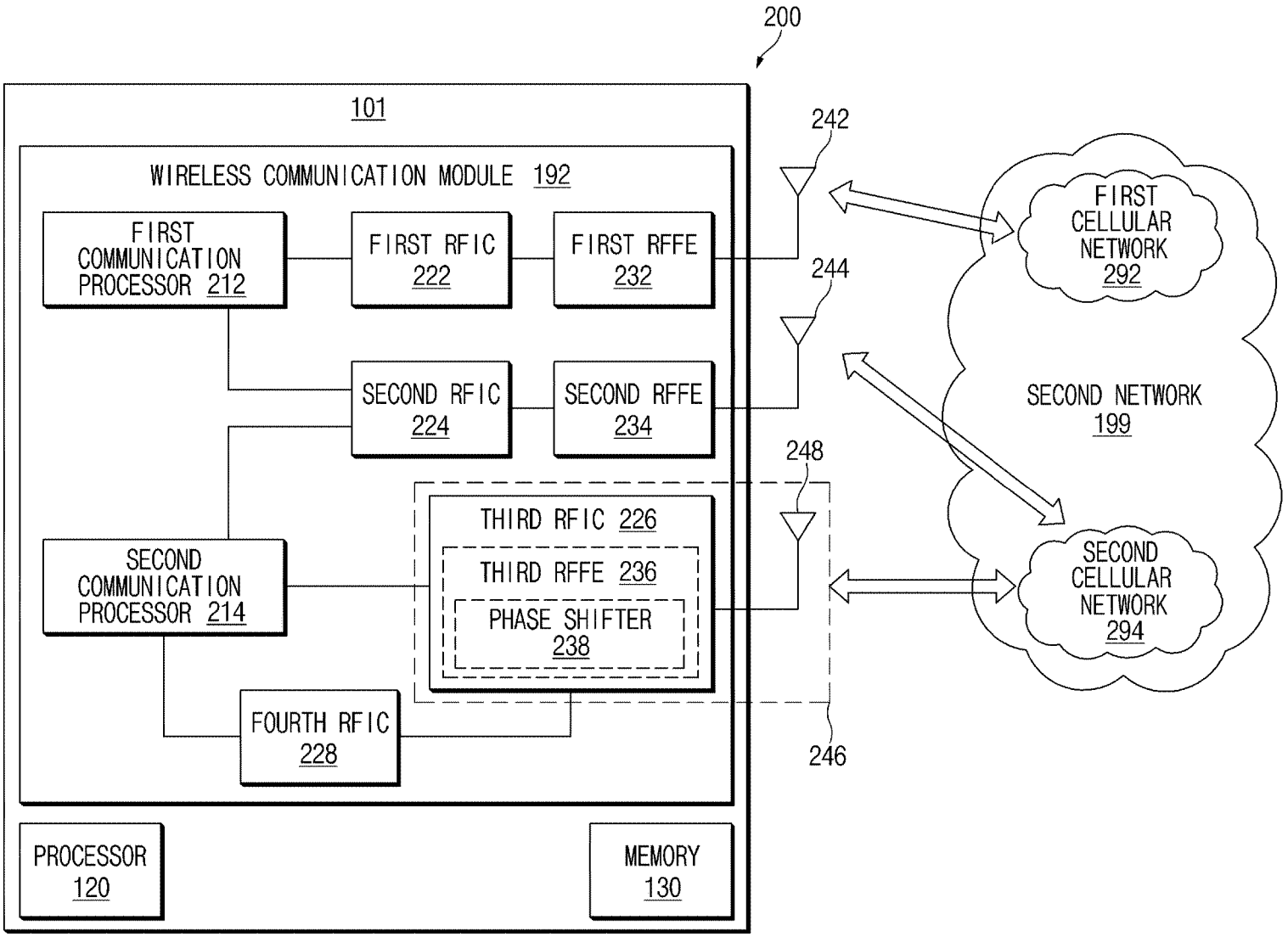
FIG. 2 is a block diagram of an electronic device for supporting legacy network communication and 5G network communication according to an embodiment of the disclosure.

FIG. 2 is a block diagram 200 of the electronic device 101 for supporting legacy network communication and 5G network communication, according to an embodiment of the disclosure.

Referring to FIG. 2, the electronic device 101 may include a first communication processor 212, a second communication processor 214, a first radio frequency integrated circuit (RFIC) 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include the processor 120 and the memory 130. The second network 199 may include a first cellular network 292 and a second cellular network 294. According to another embodiment, the electronic device 101 may further include at least one of the components illustrated in FIG. 1, and the second network 199 may include at least one other network. According to an embodiment, the first communication processor 212, the second communication processor 214, the first RFIC 222, the second RFIC 224, the fourth RFIC 228, the first RFFE 232, and the second RFFE 234 may form at least a part of the wireless communication module 192. According to another embodiment, the fourth RFIC 228 may be omitted or may be included as a part of the third RFIC 226.

The first communication processor 212 may establish a communication channel of a band to be used for wireless communication with the first cellular network 292 and may support legacy network communication over the established communication channel According to various embodiments, the first cellular network 292 may be a legacy network including 2G, 3G, 4G, and/or long term evolution (LTE) network. The second communication processor 214 may establish a communication channel corresponding to a specified band (e.g., approximately 6 GHz to approximately 60 GHz) of bands to be used for wireless communication with the second cellular network 294 and may support the 5G network communication over the established communication channel According to various embodiments, the second cellular network 294 may be a 5G network defined in the 3rd generation partnership project (3GPP). Additionally, according to an embodiment, the first communication processor 212 or the second communication processor 214 may establish a communication channel corresponding to another specified band (e.g., approximately 6 GHz or lower) of the bands to be used for wireless communication with the second cellular network 294 and may support the 5G network communication over the established communication channel According to an embodiment, the first communication processor 212 and the second communication processor 214 may be implemented in a single chip or a single package. According to various embodiments, the first communication processor 212 or the second communication processor 214 may be implemented in a single chip or a single package together with the processor 120, the auxiliary processor 123 of FIG. 1, or the communication module 190 of FIG. 1.

In the case of transmitting a signal, the first RFIC 222 may convert a baseband signal generated by the first communication processor 212 into a radio frequency (RF) signal of approximately 700 MHz to approximately 3 GHz that is used in the first cellular network 292 (e.g., a legacy network). In the case of receiving a signal, an RF signal may be obtained from the first cellular network 292 (e.g., a legacy network) through an antenna (e.g., the first antenna module 242) and may be pre-processed through an RFFE (e.g., the first RFFE 232). The first RFIC 222 may convert the pre-processed RF signal into a baseband signal so as to be processed by the first communication processor 212.

In the case of transmitting a signal, the second RFIC 224 may convert a baseband signal generated by the first communication processor 212 or the second communication processor 214 into an RF signal (hereinafter referred to as a "5G Sub6 RF signal") in a Sub6 band (e.g., approximately 6 GHz or lower) used in the second cellular network 294 (e.g., a 5G network). In the case of receiving a signal, a 5G Sub6 RF signal may be obtained from the second cellular network 294 (e.g., a 5G network) through an antenna (e.g., the second antenna module 244) and may be pre-processed through an RFFE (e.g., the second RFFE 234). The second RFIC 224 may convert the pre-processed 5G Sub6 RF signal into a baseband signal so as to be processed by a corresponding communication processor of the first communication processor 212 or the second communication processor 214.

The third RFIC 226 may convert a baseband signal generated by the second communication processor 214 into an RF signal (hereinafter referred to as a "5G Above6 RF signal") in a 5G Above6 band (e.g., approximately 6 GHz to approximately 60 GHz) to be used in the second cellular network 294 (e.g., a 5G network). In the case of receiving a signal, a 5G Above6 RF signal may be obtained from the second cellular network 294 (e.g., a 5G network) through an antenna (e.g., the antenna 248) and may be pre-processed through a third RFFE 236. For example, the third RFFE 236 may perform pre-processing on a signal by using a phase shifter 238. The third RFIC 226 may convert the pre-processed 5G Above6 RF signal into a baseband signal so as to be processed by the second communication processor 214. According to an embodiment, the third RFFE 236 may be implemented as a part of the third RFIC 226.

According to an embodiment, the electronic device 101 may include the fourth RFIC 228 independently of the third RFIC 226 or as at least a part of the third RFIC 226. In this case, the fourth RFIC 228 may convert a baseband signal generated by the second communication processor 214 into an RF signal (hereinafter referred to as an "intermediate frequency (IF) signal") in an intermediate frequency band (e.g., approximately 9 GHz to approximately 11 GHz) and may provide the IF signal to the third RFIC 226. The third RFIC 226 may convert the IF signal into the 5G Above6 RF signal. In the case of receiving a signal, a 5G Above6 RF signal may be received from the second cellular network 294 (e.g., a 5G network) through an antenna (e.g., the third antenna 248) and may be converted into an IF signal by the third RFIC 226. The fourth RFIC 228 may convert the IF signal into a baseband signal so as to be processed by the second communication processor 214.

According to an embodiment, the first RFIC 222 and the second RFIC 224 may be implemented as at least a part of a single package or a single chip. According to an embodiment, the first RFFE 232 and the second RFFE 234 may be implemented as at least a part of a single package or a single chip. According to an embodiment, at least one of the first antenna module 242 or the second antenna module 244 may be omitted or may be combined with any other antenna module to process RF signals in a plurality of bands.

According to an embodiment, the third RFIC 226 and the antenna 248 may be disposed at the same substrate to form a third antenna module 246. For example, the wireless communication module 192 or the processor 120 may be disposed on a first substrate (e.g., a main PCB). In this case, the third RFIC 226 may be disposed in a partial region (e.g., on a lower surface) of a second substrate (e.g., a sub PCB) independent of the first substrate, and the antenna 248 may be disposed in another partial region (e.g., on an upper surface) of the second substrate. As such, the third antenna module 246 may be formed. According to an embodiment, the antenna 248 may include, for example, an antenna array capable of being used for beamforming. As the third RFIC 226 and the antenna 248 are disposed at the same substrate, it may be possible to decrease a length of a transmission line between the third RFIC 226 and the antenna 248. For example, the decrease in the transmission line may make it possible to prevent a signal in a high-frequency band (e.g., approximately 6 GHz to approximately 60 GHz) used for the 5G network communication from being lost (or attenuated) due to the transmission line. As such, the electronic device 101 may improve the quality or speed of communication with the second cellular network 294 (e.g., a 5G network).

The second cellular network 294 (e.g., a 5G network) may be used independently of the first cellular network 292 (e.g., a legacy network) (e.g., this scheme being called "standalone (SA)") or may be used in connection with the first cellular network 292 (e.g., this scheme being called "non-standalone (NSA)"). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 101 may access the access network of the 5G network and may then access an external network (e.g., Internet) under control of a core network (e.g., an evolved packed core (EPC)) of the legacy network. Protocol information (e.g., LTE protocol information) for communication with the legacy network or protocol information (e.g., New Radio (NR) protocol information) for communication with the 5G network may be stored in the memory 130 so as to be accessed by any other component (e.g., the processor 120, the first communication processor 212, or the second communication processor 214).

Figure 3:
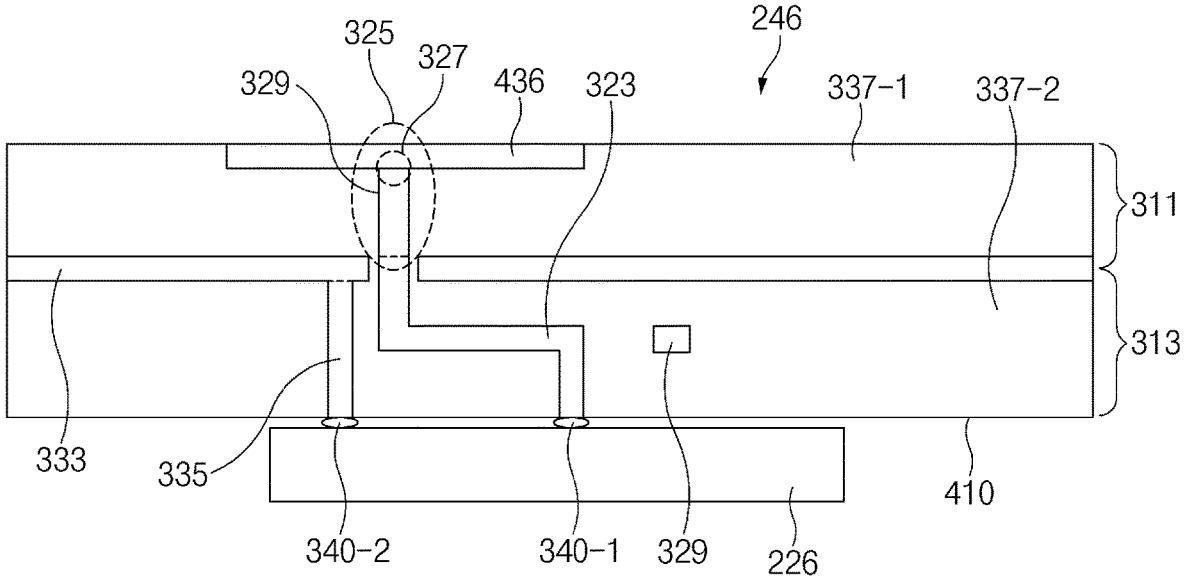
FIG. 3 illustrates a cross-sectional view of a third antenna module taken along line B-B' of FIG. 4 according to an embodiment of the disclosure.
Figure 4:
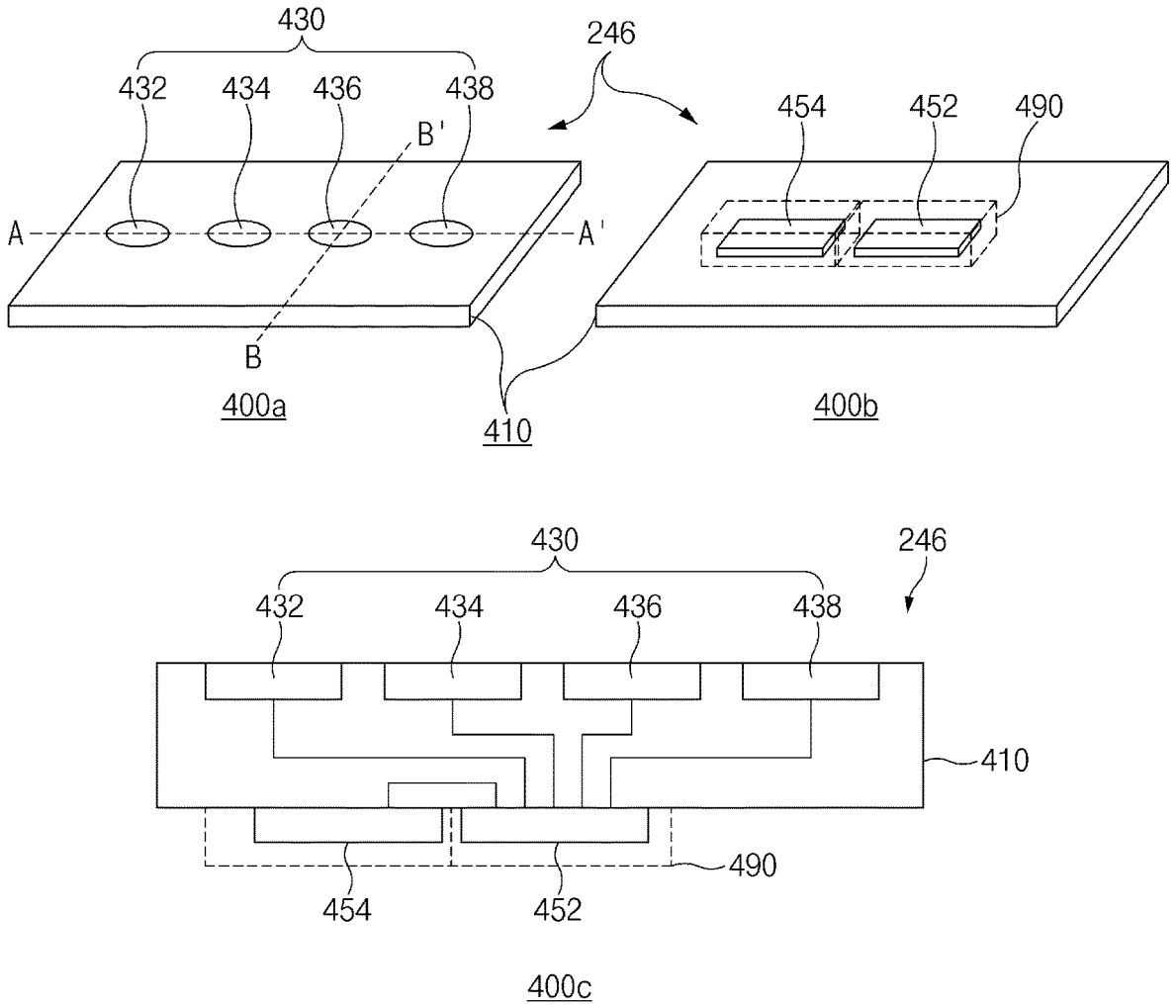
FIG. 4 illustrates an embodiment of a structure of a third antenna module of FIG. 2 according to an embodiment of the disclosure.

FIG. 3 illustrates a cross-sectional view of the third antenna module 246 taken along line B-B' of reference numeral 400*a* of FIG. 4 according to an embodiment of the disclosure.

Referring to FIG. 3, a printed circuit board (PCB) 410 may include an antenna layer 311 and a network layer 313. The antenna layer 311 may include at least one dielectric layer 337-1, and an antenna element 436 and/or a feeding part 325 formed on an outer surface of the dielectric layer 337-1 or therein. The feeding part 325 may include a feeding point 327 and/or a feeding line 329. The network layer 313 may include at least one dielectric layer 337-2; and at least one ground layer 333, at least one conductive via 335, a transmission line 323, and/or a signal line 329 formed on an outer surface of the dielectric layer 337-2 or therein.

In addition, in the embodiment illustrated, the third RFIC 226 may be electrically connected with the network layer 313, for example, through first and second connection parts (e.g., solder bumps) 340-1 and 340-2. In other embodiments, various connection structures (e.g., soldering or a ball grid array (BGA)) may be utilized instead of the connection parts 340-1 and 340-2. The third RFIC 226 may be electrically connected with the antenna element 436 through the first connection part 340-1, the transmission line 323, and the feeding part 325. Also, the third RFIC 226 may be electrically connected with the ground layer 333 through the second connection part 340-2 and the conductive via 335. Although not illustrated, the third RFIC 226 may also be electrically connected with the above module interface through the signal line 329.

FIG. 4 illustrates an embodiment of a structure of the third antenna module 246 described with reference to FIG. 2 according to an embodiment of the disclosure.

Referring to FIG. 4, 400*a* is a perspective view of the third antenna module 246 when viewed from one side, and 400*b* is a perspective view of the third antenna module 246 when viewed from another side. In FIG. 4, 400*c* is a cross-sectional view of the third antenna module 246 taken along line A-A'.

Referring to FIG. 4, in an embodiment, the third antenna module 246 may include the printed circuit board 410, an antenna array 430, a radio frequency integrated circuit (RFIC) 452 (e.g., the third RFIC 226 of FIG. 2), a power manage integrated circuit (PMIC) 454, and a module interface (not illustrated). Selectively, the third antenna module 246 may further include a shielding member 490. In other embodiments, at least one of the above components may be omitted, or at least two of the above components may be integrally formed.

The printed circuit board 410 may include a plurality of conductive layers and a plurality of non-conductive layers, and the conductive layers and the non-conductive layers may be alternately stacked. The printed circuit board 410 may provide an electrical connection with various electronic components, which are disposed on the printed circuit board 410 and/or on the outside, by using wires and conductive vias formed in the conductive layers.

The antenna array 430 (e.g., the antenna 248 of FIG. 2) may include a plurality of antenna elements 432, 434, 436, and 438 disposed to form a directional beam. The antenna elements 432, 434, 436, and 438 may be formed on a first surface of the printed circuit board 410 as illustrated. According to another embodiment, the antenna array 430 may be formed within the printed circuit board 410. According to various embodiments, the antenna array 430 may include a plurality of antenna arrays (e.g., a dipole antenna array and/or a patch antenna array) that are identical or different in shape or kind.

The RFIC 452 may be disposed in another region (e.g., a second surface facing away from the first surface) of the printed circuit board 410 so as to be spaced from the antenna array 430. The RFIC 452 may be configured to process a signal in a selected frequency band, which is transmitted/received through the antenna array 430. According to an embodiment, in the case of transmitting a signal, the RFIC 452 may convert a baseband signal obtained from a communication processor (not illustrated) into an RF signal in a specified band. In the case of receiving a signal, the RFIC 452 may convert an RF signal received through the antenna array 430 into a baseband signal and may provide the baseband signal to a communication processor (e.g., the second communication processor 214 of FIG. 2).

According to another embodiment, in the case of transmitting a signal, the RFIC 452 may up-convert an IF signal (e.g., approximately 9 GHz to approximately 11 GHz) obtained from an intermediate frequency integrated circuit (IFIC) (e.g., the fourth RFIC 228 of FIG. 2) into an RF signal in a selected band. In the case of receiving a signal, the RFIC 452 may down-convert an RF signal obtained through the antenna array 430 so as to be converted into an IF signal, and may provide the IF signal to the IFIC.

The PMIC 454 may be disposed in another region (e.g., on the second surface) of the printed circuit board 410, which is spaced from the antenna array 430. The PMIC 454 may be supplied with a voltage from a main PCB (not illustrated) and may provide a power necessary for various components (e.g., the RFIC 452) on the third antenna module 246.

The shielding member 490 may be disposed on a portion (e.g., on the second surface) of the printed circuit board 410 such that at least one of the RFIC 452 or the PMIC 454 is electromagnetically shielded. According to an embodiment, the shielding member 490 may include a shield scan.

Although not illustrated, in various embodiments, the third antenna module 246 may be electrically connected with another printed circuit board (e.g., a main PCB) through the module interface. The module interface may include a connection member, for example, a coaxial cable connector, a board to board connector, an interposer, or a flexible printed circuit board (FPCB). The RFIC 452 and/or the PMIC 454 of the third antenna module 246 may be electrically connected with the other printed circuit board through the connection member.

Figure 5A:
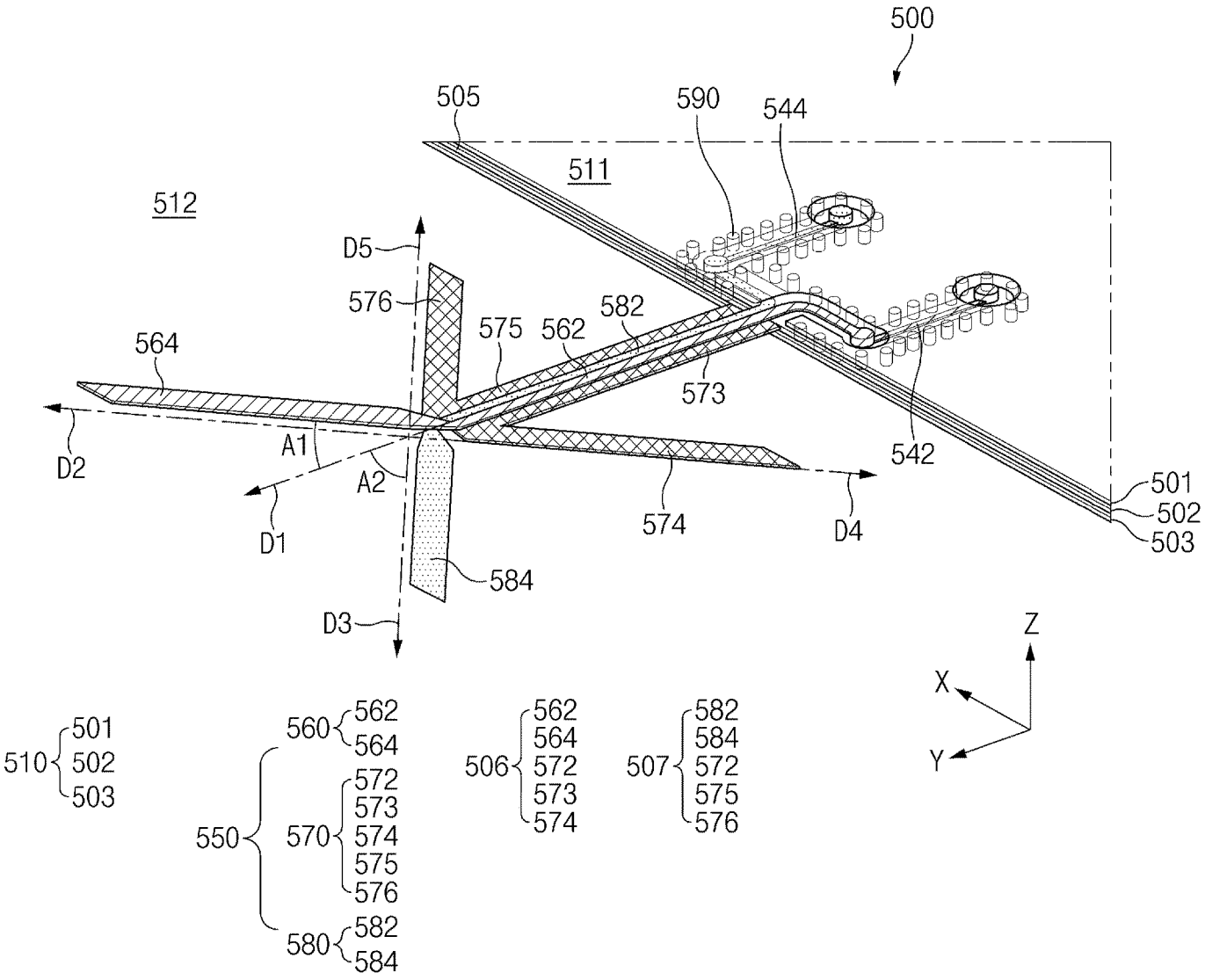
FIG. 5A is a front perspective view of an antenna structure of a first type according to an embodiment of the disclosure.

FIG. 5A is a front perspective view of an antenna structure 500 of a first type according to an embodiment of the disclosure.

Figure 5B:
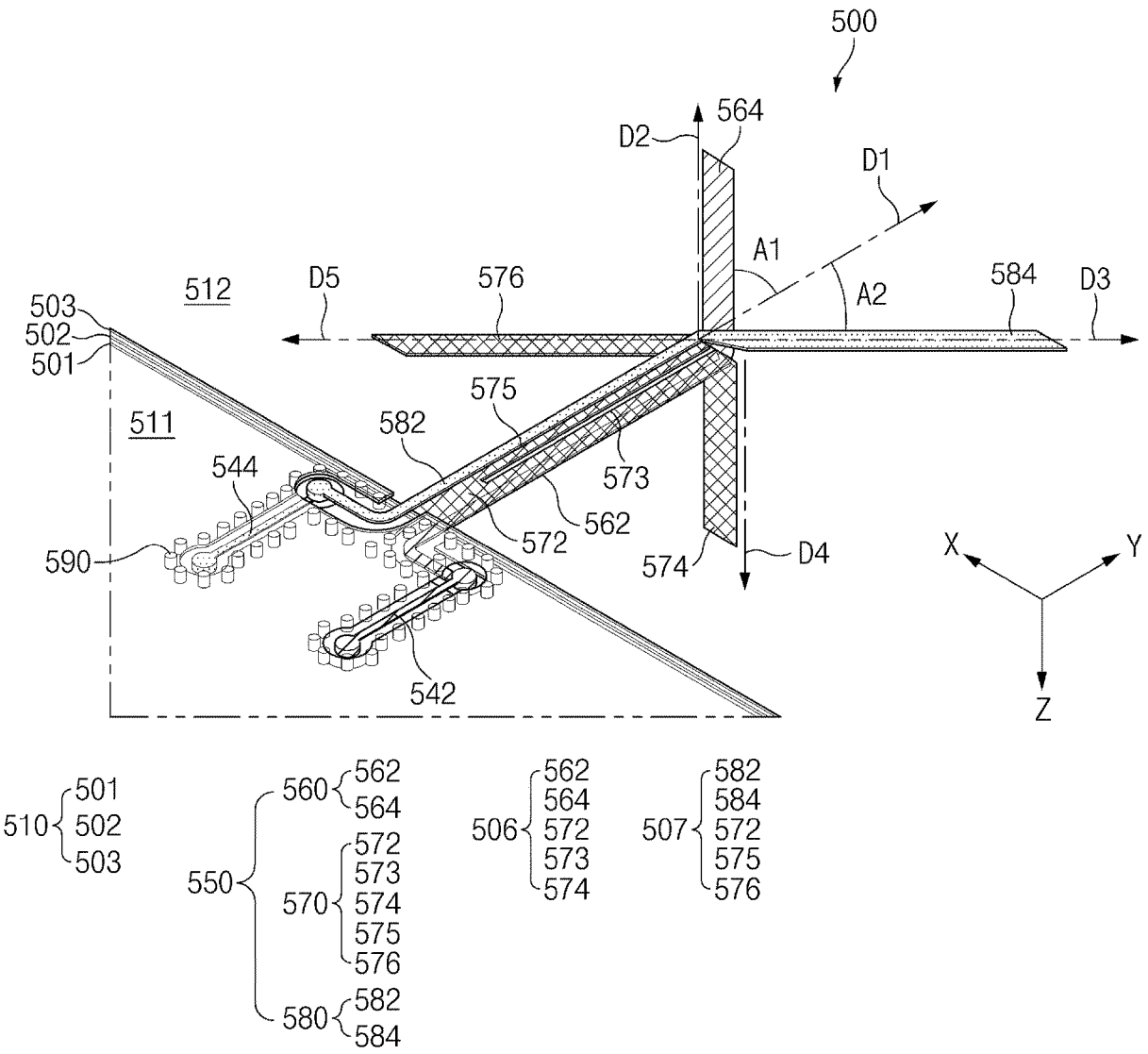
FIG. 5B is a back perspective view of an antenna structure of a first type according to an embodiment of the disclosure.

FIG. 5B is a back perspective view of the antenna structure 500 of the first type according to an embodiment of the disclosure.

Below, in the specification, an antenna structure may mean a component of an antenna module (e.g., the third antenna module 246 of FIG. 2), which does not include an RFIC (e.g., the RFIC 452 of FIG. 4) and/or a PMIC (e.g., the PMIC 454 of FIG. 4).

Referring to FIG. 5A or 5B, the antenna structure 500 of the first type may include at least one antenna element 550 (e.g., the antenna element 432, 434, 436, or 438 of FIG. 4) formed on at least a partial region of a printed circuit board 510 (e.g., the printed circuit board 410 of FIG. 4).

According to an embodiment, the printed circuit board 510 may include a plurality of conductive layers stacked in a specified direction (e.g., a positive direction of the z-axis). According to an embodiment, the printed circuit board 510 may include a rigid printed circuit board and/or a flexible printed circuit board. In an N-th layer (N being a natural number), "N" may be only a number randomly marked/mentioned to describe a structure of the antenna structure 500 in order from top to bottom (e.g., in a negative direction of the z-axis), not intended to indicate an order in which layers are stacked. For example, the printed circuit board 510 may include a third layer 503, a second layer 502 stacked on the third layer 503 (e.g., in the positive direction of the z-axis), and a first layer 501 stacked on the second layer 502. The first layer 501 and the second layer 502 or the second layer 502 and the third layer 503 may be adjacent to each other. For another example, any other layer may be additionally stacked between the first layer 501 and the second layer 502 or between the second layer 502 and the third layer 503. According to an embodiment, the printed circuit board 510 may include a first region 511 or a second region 512 on an xy-plane. The first region 511 may include a conductive material. For example, the first region 511 may include a ground region (GND). The second region 512 may include a non-conductive material (e.g., a dielectric material). For example, the second region 512 may include a fill-cut region.

According to an embodiment, the antenna element 550 included in the antenna structure 500 of the first type may include a first dipole antenna 506 and a second dipole antenna 507, which have an "X" shape, by using a plurality of conductive patterns 560, 570, and 580 formed on the plurality of layers 501, 502, and 503. According to an embodiment, the antenna element 550 may be extended from at least a portion of a periphery 505 of the first region 511 in a y-axis direction and may be formed in the second region 512. FIGS. 5A and 5B show the periphery 505 indicating a shape of a straight line, but a shape and a length of the periphery 505 is not limited to the example illustrated in FIGS. 5A and 5B.

According to an embodiment, the first conductive pattern 560 may be formed at the first layer 501, the second conductive pattern 570 may be formed at the second layer 502, and the third conductive pattern 580 may be formed at the third layer 503. The first conductive pattern 560 may be electrically connected with a first feeding line 542, the third conductive pattern 580 may be electrically connected with a second feeding line 544, and the second conductive pattern 570 may be electrically connected with the ground region. Although not illustrated in FIGS. 5A and 5B, the first feeding line 542 and the second feeding line 544 may be electrically connected with a wireless communication circuit (e.g., the third RFIC 226 of FIG. 2) configured to process a signal (e.g., a 5G Sub6 RF signal or a 5G Above6 RF signal) in a specified frequency band.

According to an embodiment, to electrically block the first feeding line 542 or the second feeding line 544, the antenna structure 500 may further include at least one via (e.g., 590 of FIG. 5A or 5B) surrounding the first feeding line 542 or the second feeding line 544 on the xy plane.

According to an embodiment, the first conductive pattern 560 may include a first conductive line 562 electrically connected with the first feeding line 542 and a first radiation part 564 configured to radiate an RF signal in a specified frequency band. The first conductive line 562 may include a transmission line. The first conductive line 562 may be extended in a first direction D1 parallel to the first layer 501 (or the first direction D1 perpendicular to the periphery 505). The first direction D1 may mean, for example, a positive direction of the y-axis. In an embodiment, the first radiation part 564 may include a conductive strip. The first radiation part 564 may be extended from the first conductive line 562 and may be bent from the first conductive line 562 as much as a first angle A1. In an embodiment, the first angle A1 may mean an angle between 0 degree and −90 degrees. For example, the first angle A1 may include −45 degrees. A direction in which the first radiation part 564 is extended may be referred to as a "second direction D2".

According to an embodiment, the third conductive pattern 580 may include a second conductive line 582 electrically connected with the second feeding line 544 and a second radiation part 584 configured to radiate an RF signal in a specified frequency band. The second conductive line 582 may include a transmission line. The second conductive line 582 may be extended substantially in parallel with the first conductive line 562. For example, the second conductive line 582 may be extended in the first direction D1. In an embodiment, the second radiation part 584 may include a conductive strip. The second radiation part 584 may be extended from the second conductive line 582 and may be bent from the second conductive line 582 as much as a second angle A2. In an embodiment, the second angle A2 may mean an angle between 0 degree and +90 degrees. For example, the second angle A2 may include +45 degrees. A direction in which the second radiation part 584 is extended may be referred to as a "third direction D3". In an embodiment, a sum of the first angle A1 and the second angle A2 may be approximately 90 degrees.

According to an embodiment, referring to FIG. 5B, the second conductive pattern 570 may include a first portion 572, a third conductive line 573, a fourth conductive line 575, a third radiation part 574, and/or a fourth radiation part 576. The first portion 572, the third conductive line 573, the fourth conductive line 575, the third radiation part 574, and/or the fourth radiation part 576 may be independent of each other or may integrally form the second conductive pattern 570.

According to an embodiment, the first portion 572 may be electrically connected with the ground region. In an embodiment, the first portion 572 may be extended substantially in parallel with the first conductive line 562 and the second conductive line 582. For example, the first portion 572 may be extended in the first direction D1 (e.g., the positive direction of the y-axis).

According to an embodiment, the third conductive line 573 and the fourth conductive line 575 may be extended from the first portion 572 in the first direction D1. The third conductive line 573 and the fourth conductive line 575 may be spaced from each other as much as a specified width (e.g., G1 of FIG. 6B) to form a slit structure.

According to an embodiment, the third radiation part 574 may be extended from the third conductive line 573, and the fourth radiation part 576 may be extended from the fourth conductive line 575.

According to an embodiment, to form the first dipole antenna 506 with the first radiation part 564, the third radiation part 574 may be extended from the third conductive line 573 in a fourth direction D4 corresponding to a direction facing away from the second direction D2. Because the first radiation part 564 is connected with the first feeding line 542, the third radiation part 574 is connected with the ground region, and a phase difference of 180 degrees occurs between the first radiation part 564 and the third radiation part 574, the first radiation part 564 and the third radiation part 574 may form the first dipole antenna 506. The first dipole antenna 506 may radiate a first RF signal in a specified frequency band in the positive direction of the z-axis and the negative direction of the z-axis. The first RF signal radiated by the first dipole antenna 506 may have a polarization characteristic in a first polarization direction parallel to the first radiation part 564 and the third radiation part 574. According to an embodiment, a sum of a length of the first radiation part 564 and a length of the third radiation part 574 may be λ/2. Here, "λ" may mean a length of a wavelength corresponding to a frequency of the first RF signal.

According to an embodiment, to form the second dipole antenna 507 with the second radiation part 584, the fourth radiation part 576 may be extended from the fourth conductive line 575 in a fifth direction D5 corresponding to a direction facing away from the third direction D3. Because the second radiation part 584 is connected with the second feeding line 544, the fourth radiation part 576 is connected with the ground region, and a phase difference of 180 degrees occurs between the second radiation part 584 and the fourth radiation part 576, the second radiation part 584 and the fourth radiation part 576 may form the second dipole antenna 507. The second dipole antenna 507 may radiate a second RF signal in the positive direction of the z-axis and the negative direction of the z-axis. The second RF signal radiated by the second dipole antenna 507 may have a polarization characteristic in a second polarization direction parallel to the second radiation part 584 and the fourth radiation part 576. Because the second polarization direction is perpendicular to the first polarization direction, the antenna structure 500 may secure isolation between the first dipole antenna 506 and the second dipole antenna 507. According to an embodiment, a sum of a length of the second radiation part 584 and a length of the fourth radiation part 576 may be λ/2. Here, "λ" may mean a length of a wavelength corresponding to a frequency of the second RF signal.

Figure 6A:
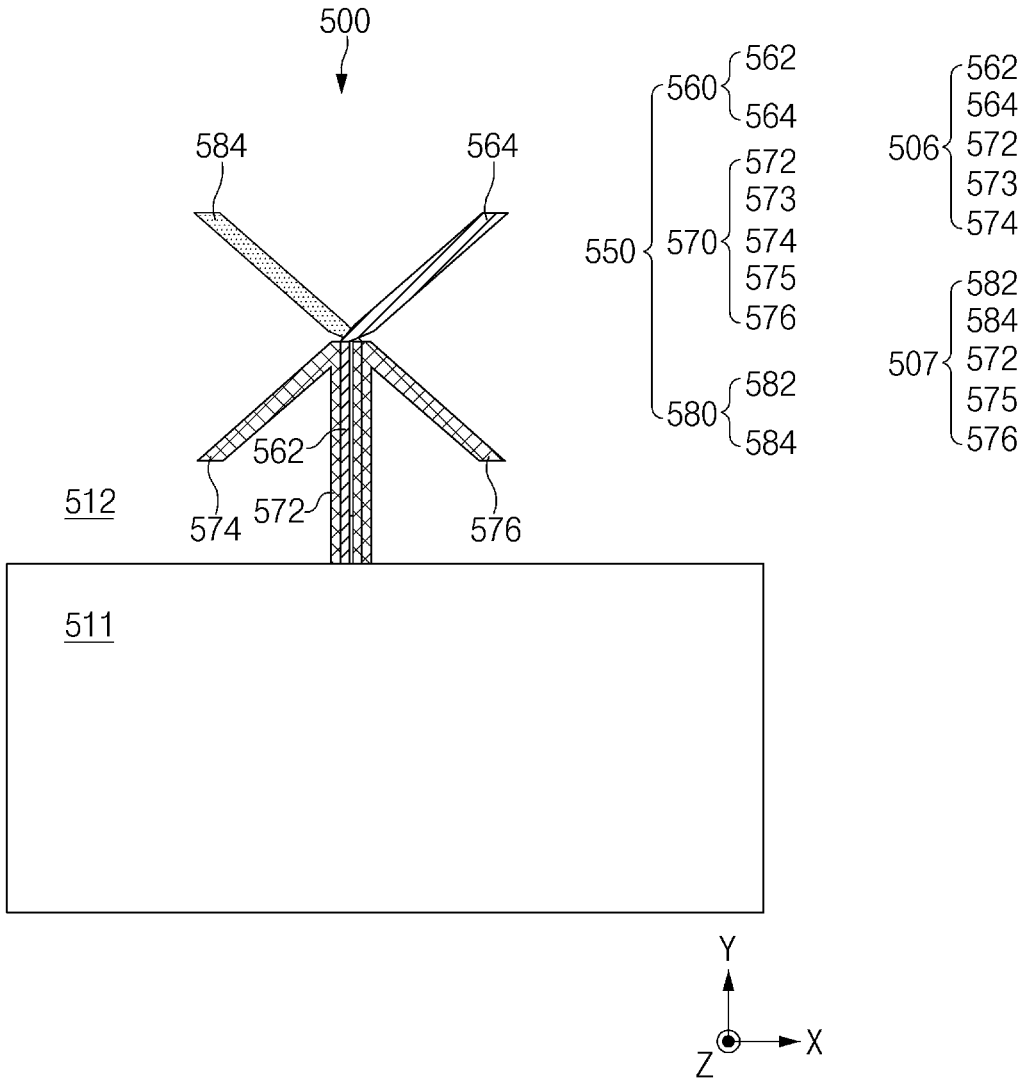
FIG. 6A is a plan view of an antenna structure of a first type according to an embodiment of the disclosure.

FIG. 6A is a plan view of the antenna structure 500 of the first type according to an embodiment of the disclosure.

Figure 6B:
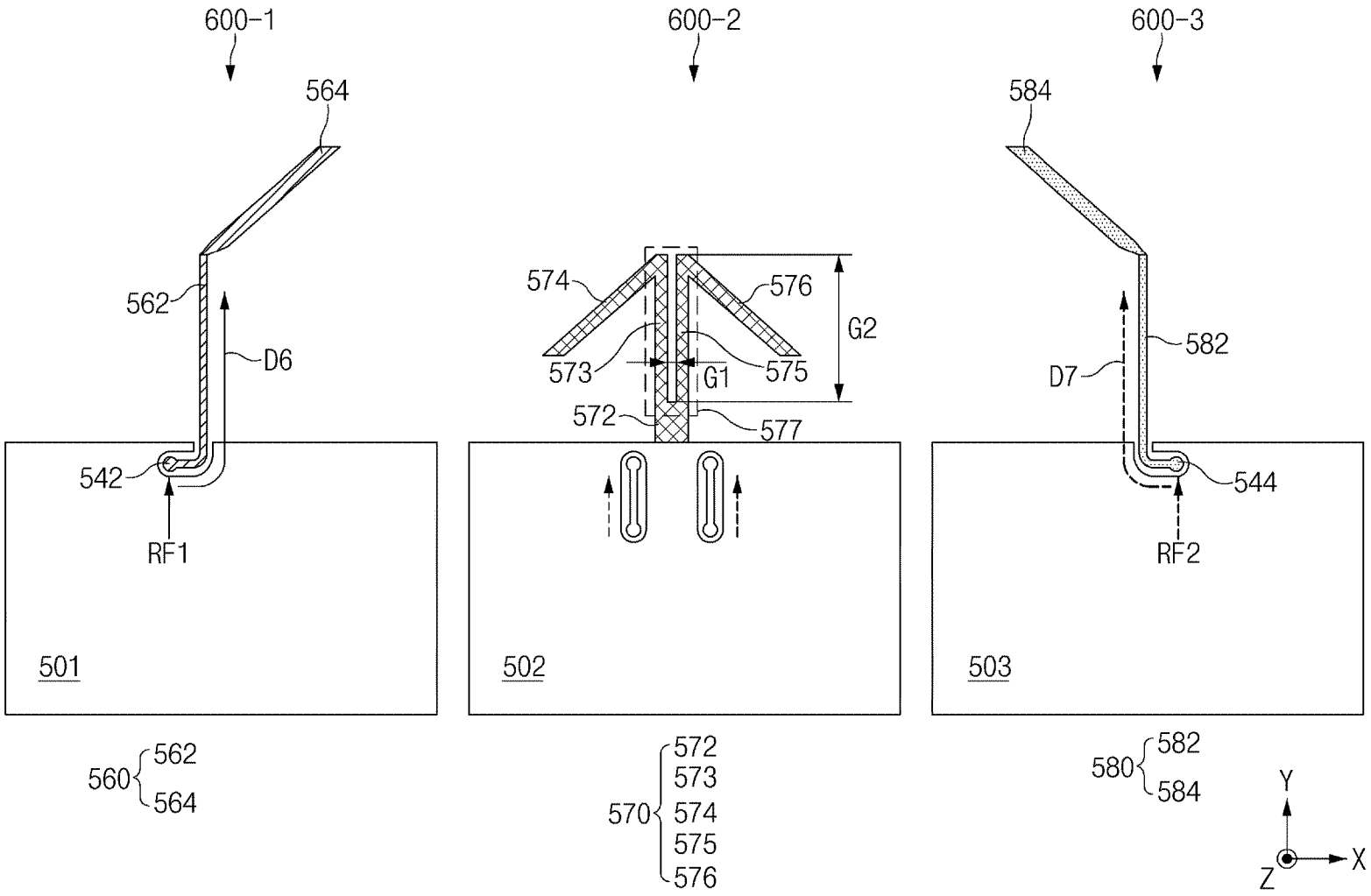
FIG. 6B is a plan view illustrating an antenna structure of a first type for each layer, according to an embodiment of the disclosure.

FIG. 6B is a plan view illustrating the antenna structure 500 of the first type for each layer, according to an embodiment of the disclosure.

When viewed from above the z-axis, the second conductive line 582 illustrated in FIGS. 5A and 5B is illustrated in FIG. 6A as being covered (or hidden) by the first portion 572, but only at least a portion of the second conductive line 582 may be covered (or hidden) by the first portion 572.

Referring to FIGS. 6A and 6B, at least a portion of the antenna element 550 forming the antenna structure 500 may be in an "X" shape when viewed from the positive direction of the z-axis. For example, the first dipole antenna 506 including the first radiation part 564 and the third radiation part 574 and the second dipole antenna 507 including the second radiation part 584 and the fourth radiation part 576 may cross each other on the xy plane in structure. In this case, on the xy plane, the first radiation part 564 may be bent while intersecting the second radiation part 584 from the first conductive line 562, and the second radiation part 584 may be bent while intersecting the first radiation part 564 from the second conductive line 582.

Reference numeral 600-1 of FIG. 6B indicates a plan view of the first layer 501. The first conductive line 562 of the first conductive pattern 560 may be electrically connected with the first feeding line 542. A wireless communication circuit (e.g., the third RFIC 226 of FIG. 2) electrically connected with the first feeding line 542 may apply a current of the first RF signal through the first feeding line 542. The current of the first RF signal may flow through the first conductive line 562 in a sixth direction D6 and may be transferred to the first radiation part 564.

Reference numeral 600-3 of FIG. 6B indicates a plan view of the third layer 503. The second conductive line 582 of the third conductive pattern 580 may be electrically connected with the second feeding line 544. A wireless communication circuit (e.g., the third RFIC 226 of FIG. 2) electrically connected with the second feeding line 544 may apply a current of the second RF signal through the second feeding line 544. The current of the second RF signal may flow through the second conductive line 582 in a seventh direction D7 and may be transferred to the second radiation part 584.

Reference numeral 600-2 of FIG. 6B indicates a plan view of the second layer 502. The second conductive pattern 570 formed at the second layer 502 may be extended from the ground region.

According to an embodiment, at least a portion (e.g., the third radiation part 574) of the second conductive pattern 570 may perform a function of the first dipole antenna 506 radiating the first RF signal, together with at least a portion (e.g., the first radiation part 564) of the first conductive pattern 560 formed at the first layer 501. According to an embodiment, at least another portion (e.g., the fourth radiation part 576) of the second conductive pattern 570 may perform a function of the second dipole antenna 507 radiating the second RF signal, together with at least a portion (e.g., the second radiation part 584) of the third conductive pattern 580 formed at the third layer 503.

According to an embodiment, to secure the isolation between the first dipole antenna 506 and the second dipole antenna 507, the second conductive pattern 570 may include a slit structure 577 that is implemented with the third conductive line 573 and the fourth conductive line 575. The slit structure 577 may have a specified width G1 and a specified length G2. The length G2 may be, for example, λ/4. Here, "λ" may mean a length of a wavelength corresponding to a frequency of an RF signal (e.g., the first RF signal or the second RF signal). The width G1 may be determined based on an interval between the first conductive line 562 and the second conductive line 582 on the xy plane such that the first conductive line 562 is disposed above the fourth conductive line 575 and the third conductive line 573 is disposed above the second conductive line 582, in a plan view.

Figure 7:
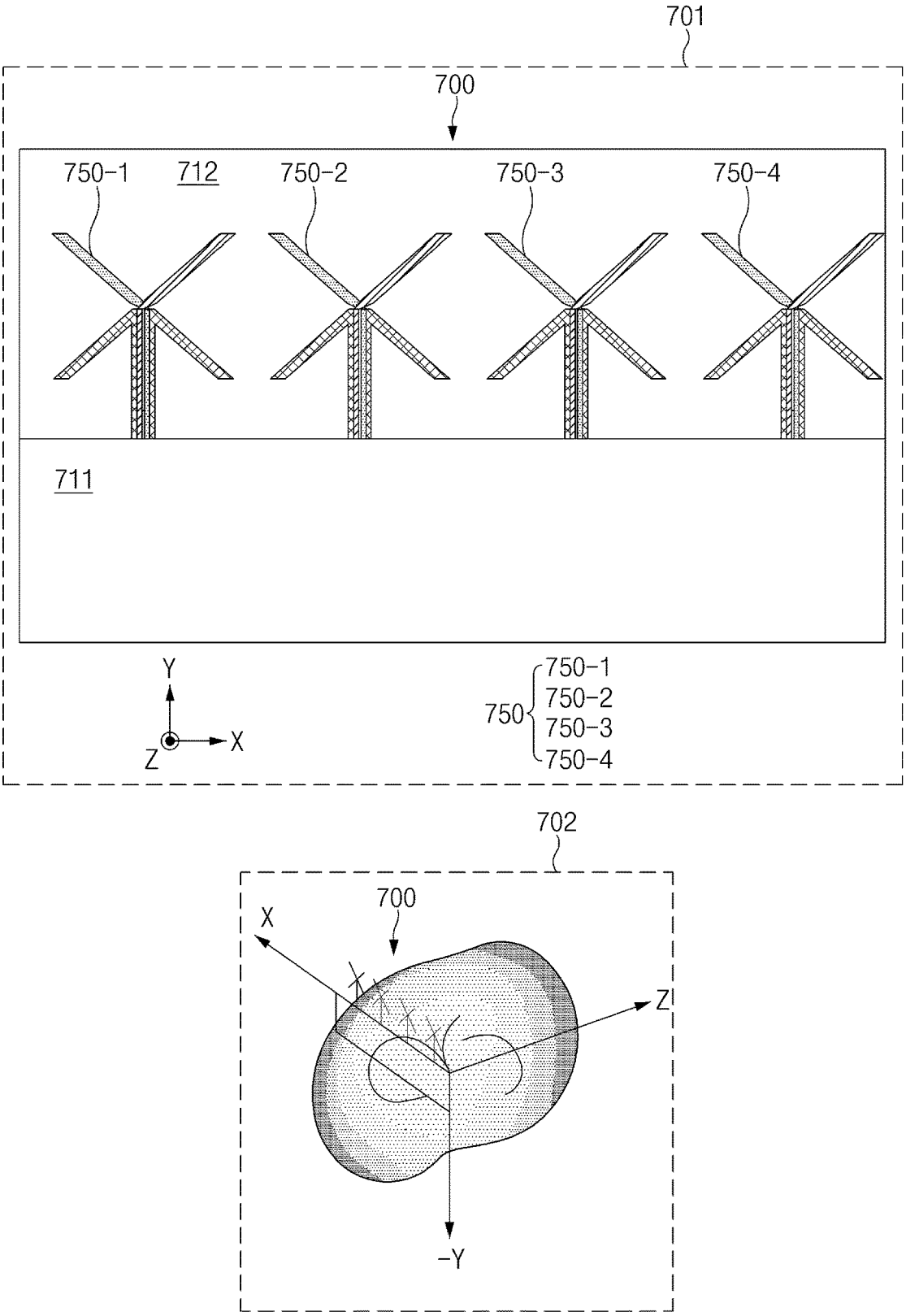
FIG. 7 illustrates a radiation pattern of a first-type antenna structure including a plurality of antenna elements according to an embodiment of the disclosure.

FIG. 7 illustrates a radiation pattern of an antenna structure 700 including a plurality of antenna elements 750-1, 750-2, 750-3, and 750-4 according to an embodiment of the disclosure.

Referring to reference numeral 701 of FIG. 7, the antenna structure 700 may include a first region 711, which forms at least a portion of a printed circuit board, or a second region 712. The first region 711 may include, for example, a structure identical or similar to that of the first region 511 of FIG. 5A, and the second region 712 may include a structure identical or similar to that of the second region 512 of FIG. 5A. In an embodiment, the second region 712 may include a non-conductive region. According to an embodiment, an edge (or a boundary line) forming the first region 711 and the second region 712 may be a boundary of a module forming the antenna structure 700.

According to an embodiment, the plurality of antenna elements 750-1, 750-2, 750-3, and 750-4 may be formed in the second region 712. The plurality of antenna elements 750-1, 750-2, 750-3, and 750-4 may include a structure identical or similar to that of the antenna element 550 of FIG. 5A. The plurality of antenna elements 750-1, 750-2, 750-3, and 750-4 may form an antenna array 750. FIG. 7 shows the antenna array 750 forming a 1×4 pattern, but the number of antenna elements constituting the antenna array 750 and a pattern of the antenna array 750 are not limited to the example illustrated in FIG. 7.

Referring to reference numeral 702 of FIG. 7, the antenna structure 700 including the antenna array 750 may form beams in opposite directions (e.g., the positive direction of the z-axis and the negative direction of the z-axis) perpendicular to a plane where the antenna array 750 is formed or to a plane (e.g., an xy plane) where the first region 711 is formed.

Figure 8:
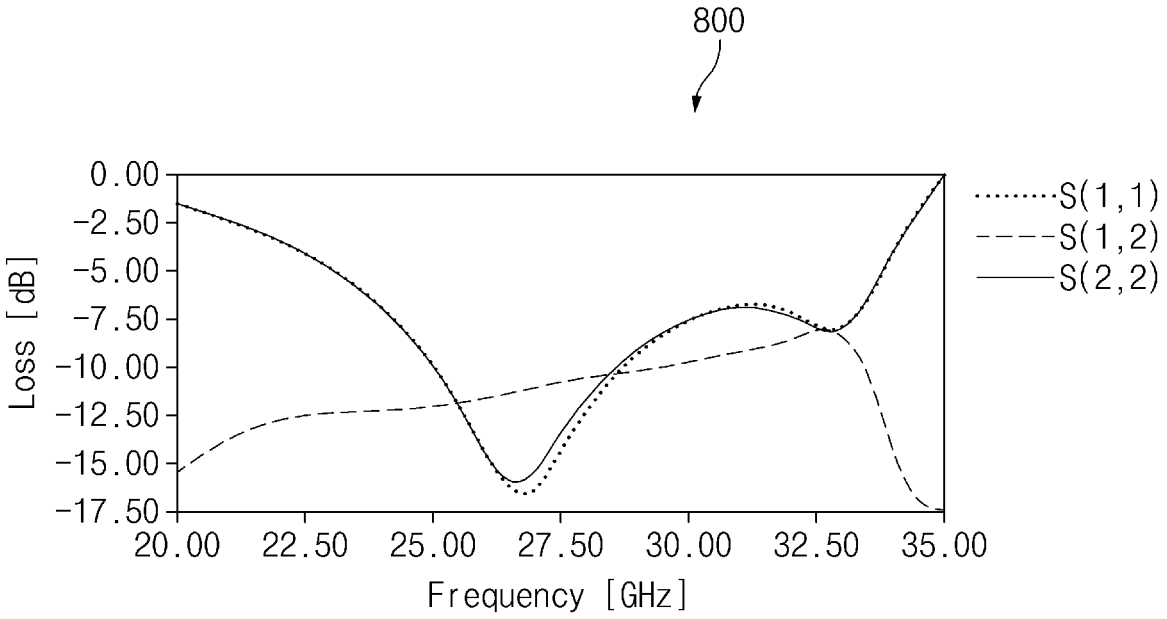
FIG. 8 illustrating a graph indicating a resonance characteristic of an antenna structure of a first type according to an embodiment of the disclosure.

FIG. 8 illustrating a graph 800 indicating a resonance characteristic of an antenna structure (e.g., 500 of FIG. 5A) of a first type according to an embodiment of the disclosure.

Referring to FIG. 8, in graph 800, a horizontal axis represents a frequency (in units of gigahertz (GHz)), and a vertical axis represents a loss (in units of decibel (dB)). In graph 800, S(1,1) and S(2,2) may indicate a change of a return loss according to a frequency, and S(1,2) may indicate a change of an insertion loss according to a frequency. Referring to graph 800, S(1,1) being the return loss of the first dipole antenna 506 and S(2,2) being the return loss of the second dipole antenna 507 may have a resonance characteristic in a 27 GHz band, and the isolation between the first dipole antenna 506 and the second dipole antenna 507 may be secured at −10 dB or less.

Figure 9A:
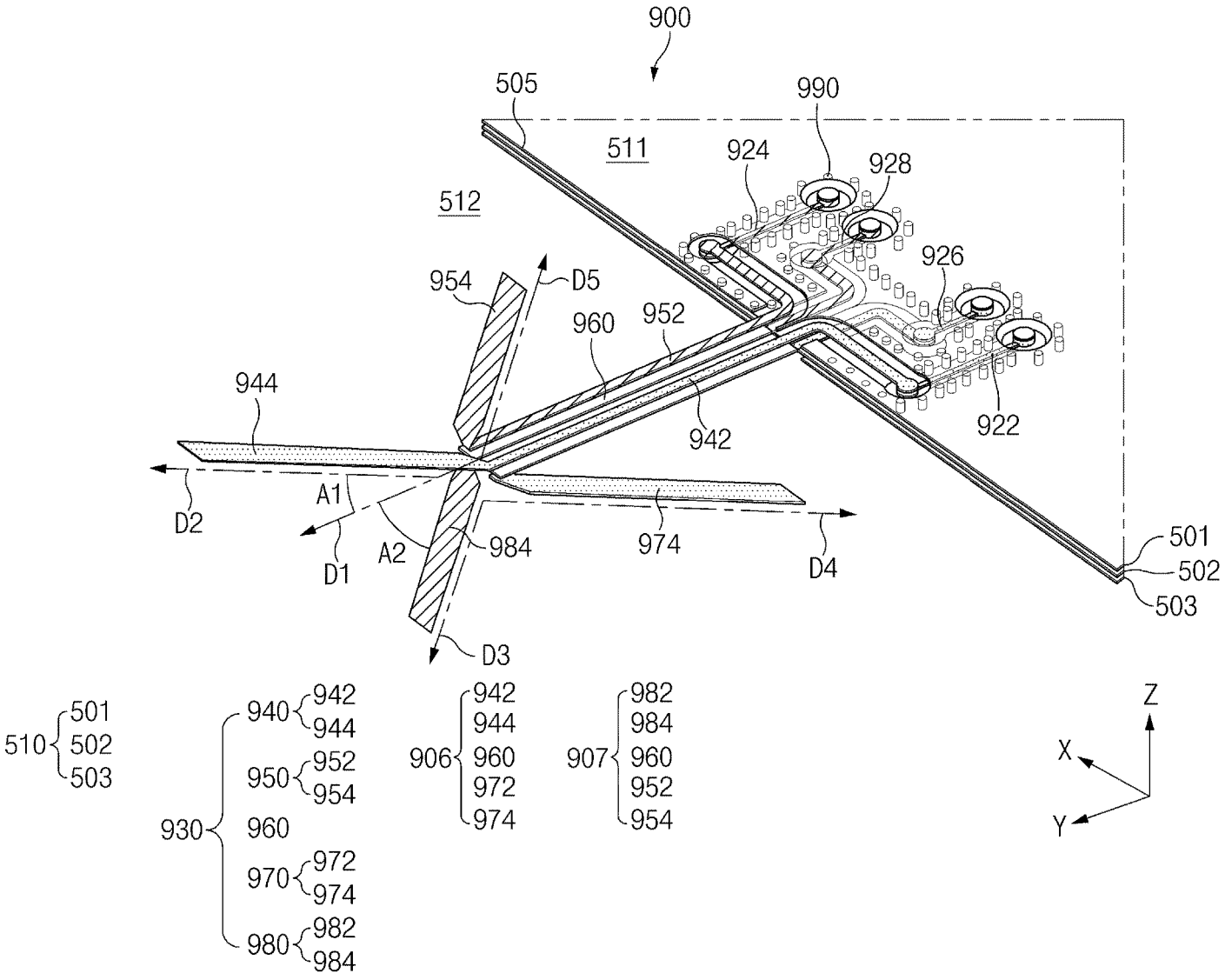
FIG. 9A is a front perspective view of an antenna structure of a second type according to an embodiment of the disclosure.

FIG. 9A is a front perspective view of an antenna structure 900 of a second type according to an embodiment of the disclosure.

Figure 9B:
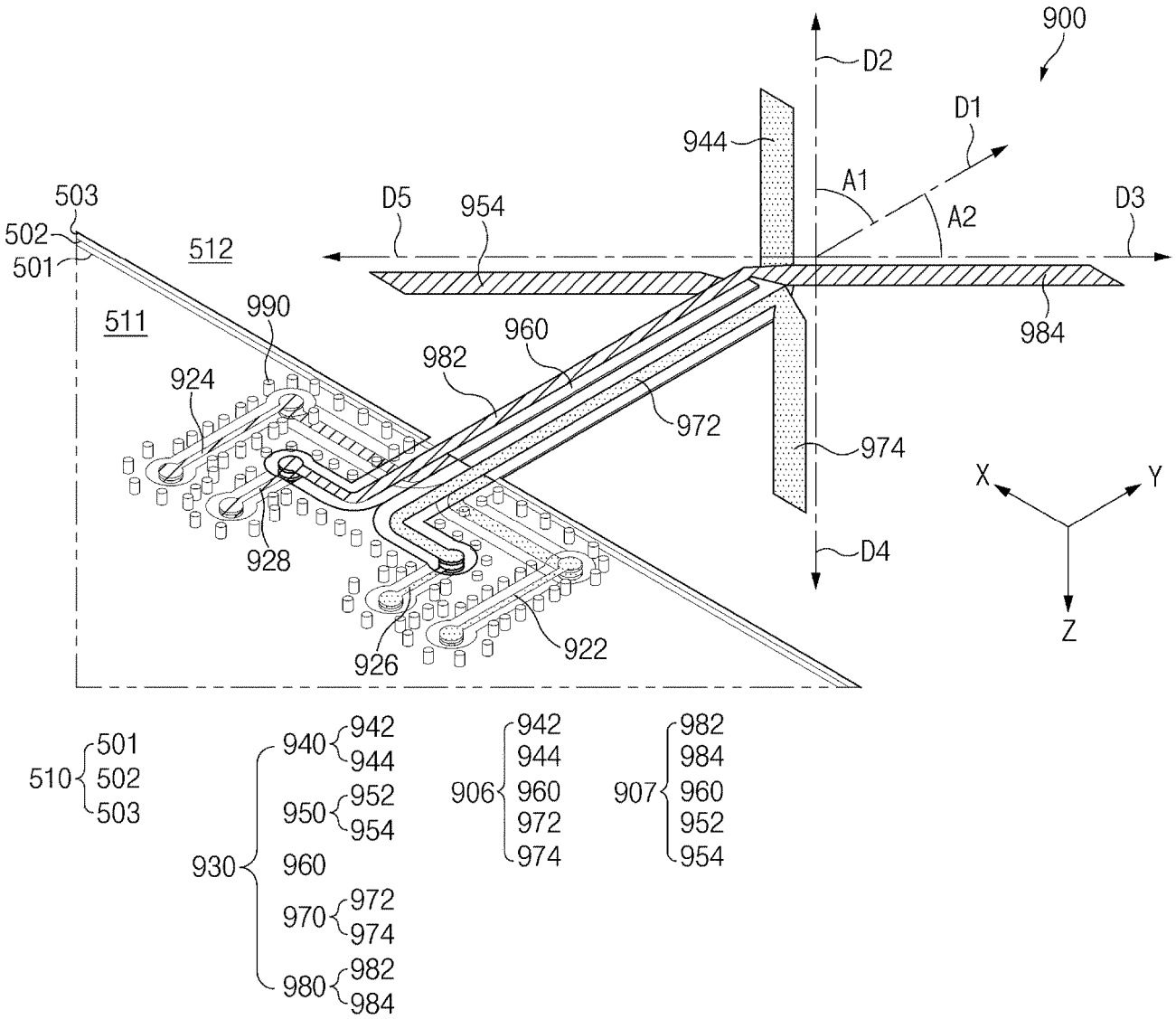
FIG. 9B is a back perspective view of an antenna structure of a second type according to an embodiment of the disclosure.

FIG. 9B is a back perspective view of the antenna structure 900 of the second type according to an embodiment of the disclosure.

In the following description, components of FIGS. 9A and 9B, which have the same reference numerals as the components illustrated in FIGS. 5A and 5B, may include the same or similar structures. Also, in the following description, like components including the terms "third" and "fourth", components that do not include the terms "first" and "second" are only for distinction of the terms "first" and "second" used in FIGS. 5A to 8, not intended to omit any other additional component.

Referring to FIG. 9A or 9B, the antenna structure 900 of the second type may include at least one antenna element 930 (e.g., the antenna element 432, 434, 436, or 438 of FIG. 4) formed in at least a partial region of the printed circuit board 510 (e.g., the printed circuit board 410 of FIG. 4). The antenna element 930 may include a third dipole antenna 906 and a fourth dipole antenna 907, which have an "X" shape, by using a plurality of conductive patterns 940, 950, 960, 970, and 980 formed at the plurality of layers 501, 502, and 503.

According to an embodiment, the fourth conductive pattern 940 and the fifth conductive pattern 950 may be formed at the first layer 501, the sixth conductive pattern 960 may be formed at the second layer 502, and the seventh conductive pattern 970 and the eighth conductive pattern 980 may be formed at the third layer 503. The fourth conductive pattern 940 may be electrically connected with a third feeding line 922, the fifth conductive pattern 950 may be electrically connected with a fourth feeding line 924, the seventh conductive pattern 970 may be electrically connected with a fifth feeding line 926, the eighth conductive pattern 980 may be electrically connected with a sixth feeding line 928, and the sixth conductive pattern 960 may be electrically connected with the ground region. Although not illustrated in FIGS. 9A and 9B, the third feeding line 922, the fourth feeding line 924, the fifth feeding line 926, and/or the sixth feeding line 928 may be electrically connected with a wireless communication circuit (e.g., the third RFIC 226 of FIG. 2) configured to process a signal (e.g., a 5G Sub6 RF signal or a 5G Above6 RF signal) in a specified frequency band.

According to an embodiment, to electrically block the third feeding line 922, the fourth feeding line 924, the fifth feeding line 926, and/or the sixth feeding line 928, the antenna structure 900 (or the electronic device 101) may further include at least one via (e.g., 990 of FIG. 9A or 9B) surrounding the third feeding line 922, the fourth feeding line 924, the fifth feeding line 926, and/or the sixth feeding line 928 on the xy plane.

According to an embodiment, the fourth conductive pattern 940 and the seventh conductive pattern 970 may be included in the third dipole antenna 906. The fourth conductive pattern 940 may include a fifth conductive line 942 electrically connected with the third feeding line 922 and a fifth radiation part 944 configured to radiate an RF signal. The fifth conductive line 942 may include a transmission line. The fifth conductive line 942 may be extended in the first direction D1. The fifth radiation part 944 may include a conductive strip. The fifth radiation part 944 may be extended from the fifth conductive line 942 and may be bent from the fifth conductive line 942 as much as the first angle A1. A direction in which the fifth radiation part 944 is extended may be referred to as the "second direction D2". The seventh conductive pattern 970 may include a seventh conductive line 972 electrically connected with the fifth feeding line 926 and a seventh radiation part 974 configured to radiate an RF signal. The seventh conductive line 972 may include a transmission line. The seventh conductive line 972 may be extended substantially in parallel with the fifth conductive line 942. The seventh radiation part 974 may include a conductive strip. The seventh radiation part 974 may be extended from the seventh conductive line 972 and may be bent in the fourth direction D4 corresponding to a direction facing away from the second direction D2. The first RF signal may be transferred through the third feeding line 922, while a 1-1st RF signal that has the same frequency band as the first RF signal but has a phase opposite to that of the first RF signal (e.g., a phase difference of 180 degrees) may be transferred through the fifth feeding line 926. As such, the fifth radiation part 944 and the seventh radiation part 974 may form the third dipole antenna 906.

According to an embodiment, the third dipole antenna 906 may radiate the first RF signal and the 1-1st RF signal in the positive direction of the z-axis and the negative direction of the z-axis. The first RF signal radiated by the third dipole antenna 906 may have a polarization characteristic in the first polarization direction parallel to the fifth radiation part 944 and the seventh radiation part 974. According to an embodiment, a sum of a length of the fifth radiation part 944 and a length of the seventh radiation part 974 may be $\lambda/2$. Here, "$\lambda$" may mean a length of a wavelength corresponding to a frequency of the first RF signal or the 1-1st RF signal.

According to an embodiment, the fifth conductive pattern 950 and the eighth conductive pattern 980 may be included in the fourth dipole antenna 907. The eighth conductive pattern 980 may include an eighth conductive line 982 electrically connected with the sixth feeding line 928 and an eighth radiation part 984 configured to radiate an RF signal. The eighth conductive line 982 may include a transmission line. The eighth conductive line 982 may be extended in the first direction D1. The eighth radiation part 984 may include a conductive strip. The eighth radiation part 984 may be extended from the eighth conductive line 982 and may be bent from the eighth conductive line 982 as much as the second angle A2. A direction in which the eighth radiation part 984 is extended may be referred to as the "third direction D3". The fifth conductive pattern 950 may include a sixth conductive line 952 electrically connected with the fourth feeding line 924 and a sixth radiation part 954 configured to radiate an RF signal. The sixth conductive line 952 may include a transmission line. The sixth conductive line 952 may be extended substantially in parallel with the eighth conductive line 982. The sixth radiation part 954 may include a conductive strip. The sixth radiation part 954 may be extended from the sixth conductive line 952 and may be bent in the fifth direction D5 corresponding to a direction facing away from the third direction D3. The second RF signal may be transferred through the fourth feeding line 924, while a 2-1st RF signal that has the same frequency band as the second RF signal but has a phase opposite to that of the second RF signal (e.g., a phase difference of 180 degrees) may be transferred through the sixth feeding line 928. As such, the sixth radiation part 954 and the eighth radiation part 984 may form the fourth dipole antenna 907.

According to an embodiment, the fourth dipole antenna 907 may radiate the second RF signal and the 2-1st RF signal in the positive direction of the z-axis and the negative direction of the z-axis. A signal radiated by the fourth dipole antenna 907 may have a polarization characteristic in the second polarization direction parallel to the sixth radiation part 954 and the eighth radiation part 984. According to an embodiment, a sum of a length of the sixth radiation part 954 and a length of the eighth radiation part 984 may be $\lambda/2$. Here, "$\lambda$" may mean a length of a wavelength corresponding to a frequency of the second RF signal or the 2-1st RF signal.

According to an embodiment, the sixth conductive pattern 960 formed at the second layer 502 may be extended from the ground region. The sixth conductive pattern 960 may be extended in the first direction D1.

Figure 10A:
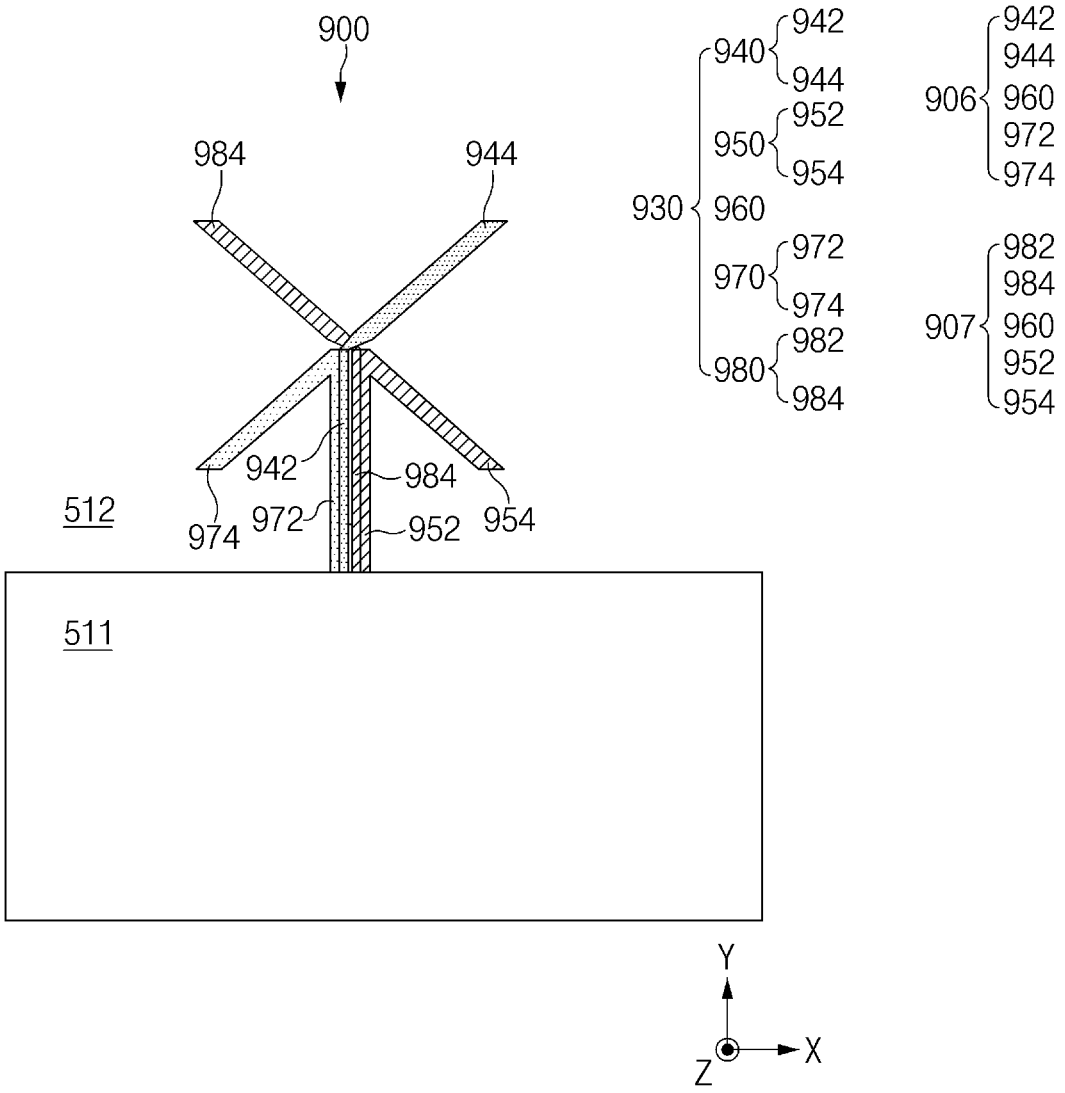
FIG. 10A is a plan view of an antenna structure of a second type according to an embodiment of the disclosure.

FIG. 10A is a plan view of the antenna structure 900 of the second type according to an embodiment of the disclosure.

Figure 10B:
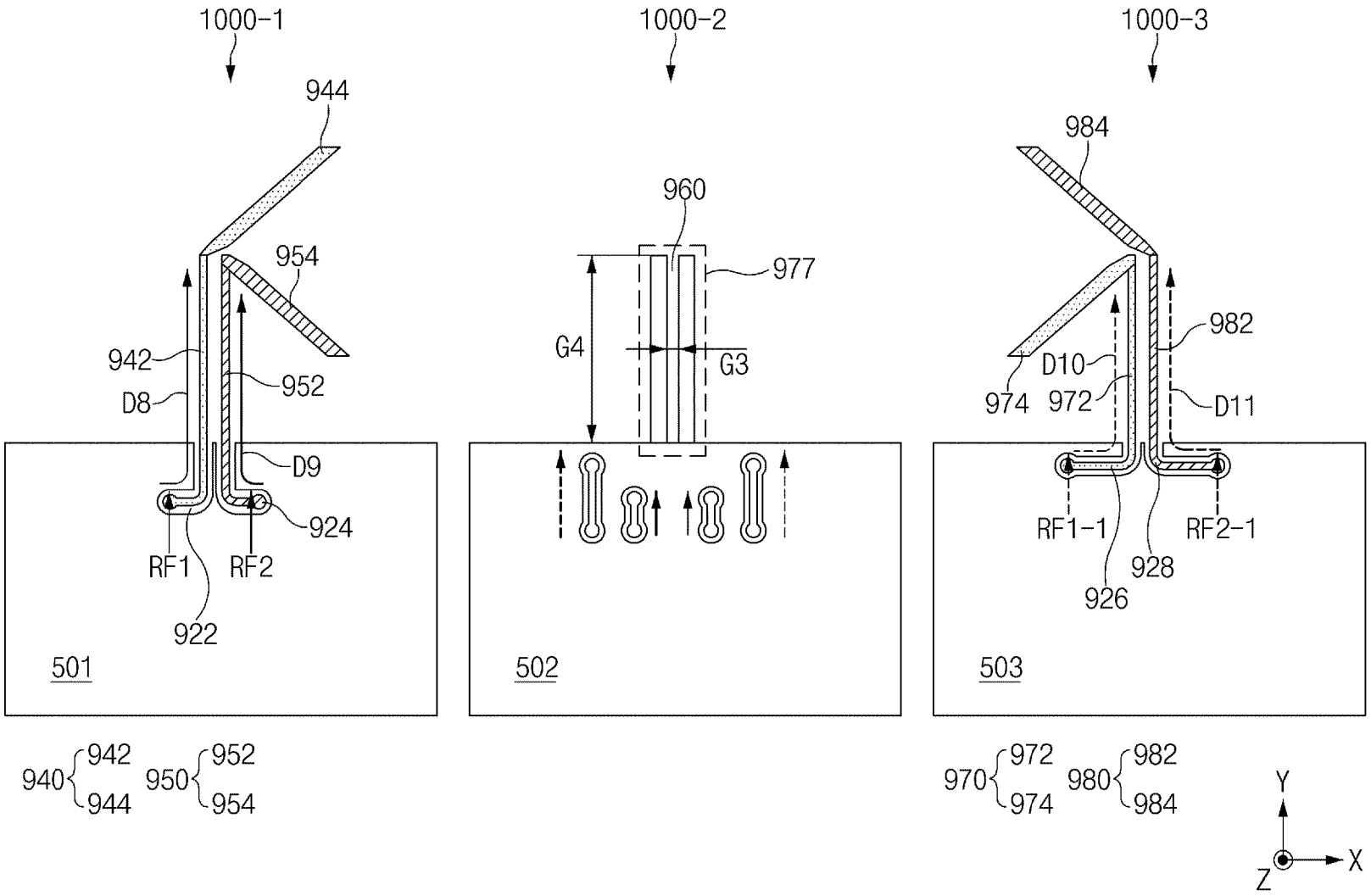
FIG. 10B is a plan view illustrating an antenna structure of a second type for each layer, according to an embodiment of the disclosure.

FIG. 10B is a plan view illustrating the antenna structure 900 of the second type for each layer, according to an embodiment of the disclosure.

FIG. 10A illustrates a plan view of the antenna structure 900 when viewed from above (e.g., in the positive direction of the z-axis), and thus, all or a part of components (e.g., the sixth conductive pattern 960, the seventh conductive line 972, or the eighth conductive line 982) illustrated in FIGS. 9A and 9B are illustrated as being covered.

Referring to FIG. 10A, at least a portion of the antenna element 930 forming the antenna structure 900 may be in an "X" shape when viewed from above. For example, the third dipole antenna 906 including the fifth radiation part 944 and the seventh radiation part 974 and the fourth dipole antenna 907 including the sixth radiation part 954 and the eighth radiation part 984 may cross each other on the xy plane in structure. In this case, on the xy plane, the fifth radiation part 944 may be extended while intersecting the fourth dipole antenna 907 from the fifth conductive line 942, and the eighth radiation part 984 may be extended while intersecting the third dipole antenna 906 from the eighth conductive line 982.

Reference numeral 1000-1 of FIG. 10B indicates a plan view of the first layer 501. The fifth conductive line 942 of the fourth conductive pattern 940 may be electrically connected with the third feeding line 922. A wireless communication circuit (e.g., the third RFIC 226 of FIG. 2) electrically connected with the third feeding line 922 may apply a current of the first RF signal through the third feeding line 922. The current of the first RF signal may flow through the fifth conductive line 942 in an eighth direction D8 and may be transferred to the fifth radiation part 944. The sixth conductive line 952 of the fifth conductive pattern 950 may be electrically connected with the fourth feeding line 924. A wireless communication circuit (e.g., the third RFIC 226 of FIG. 4) electrically connected with the fourth feeding line 924 may apply a current of the second RF signal through the fourth feeding line 924. The current of the second RF signal may flow through the sixth conductive line 952 in a ninth direction D9 and may be transferred to the sixth radiation part 954.

Reference numeral 1000-3 of FIG. 10B indicates a plan view of the third layer 503. The seventh conductive line 972 of the seventh conductive pattern 970 may be electrically connected with the fifth feeding line 926. The wireless communication circuit may apply a current of the 1-1st RF signal through the fifth feeding line 926, and the first RF signal and the 1-1st RF signal may be 180 degrees out of phase. The current of the 1-1st RF signal may flow through the seventh conductive line 972 in a tenth direction D10 and may be transferred to the seventh radiation part 974. The eighth conductive line 982 of the eighth conductive pattern 980 may be electrically connected with the sixth feeding line 928. The wireless communication circuit may apply a current of the 2-1st RF signal through the sixth feeding line 928, and the second RF signal and the 2-1st RF signal may be 180 degrees out of phase. The current of the 2-1st RF signal may flow through the eighth conductive line 982 in an eleventh direction D11 and may be transferred to the eighth radiation part 984.

Reference numeral 1000-2 of FIG. 10B indicates a plan view of the second layer 502. The sixth conductive pattern 960 formed at the second layer 502 may be extended from the ground region. According to an embodiment, to secure the isolation between the third dipole antenna 906 and the fourth dipole antenna 907, the sixth conductive pattern 960 may include a slit structure 977 having a specified width G3 and a specified length G4. The length G4 may be, for example, $\lambda/4$. Here, "$\lambda$" may mean a length of a wavelength corresponding to a frequency of an RF signal (e.g., the first RF signal or the second RF signal). The width G3 may be determined based on an interval between the fifth conductive line 942 and the sixth conductive line 952 on the xy plane such that the fifth conductive line 942 and the sixth conductive line 952 are disposed above the sixth conductive pattern 960 in a plan view.

Figure 11:
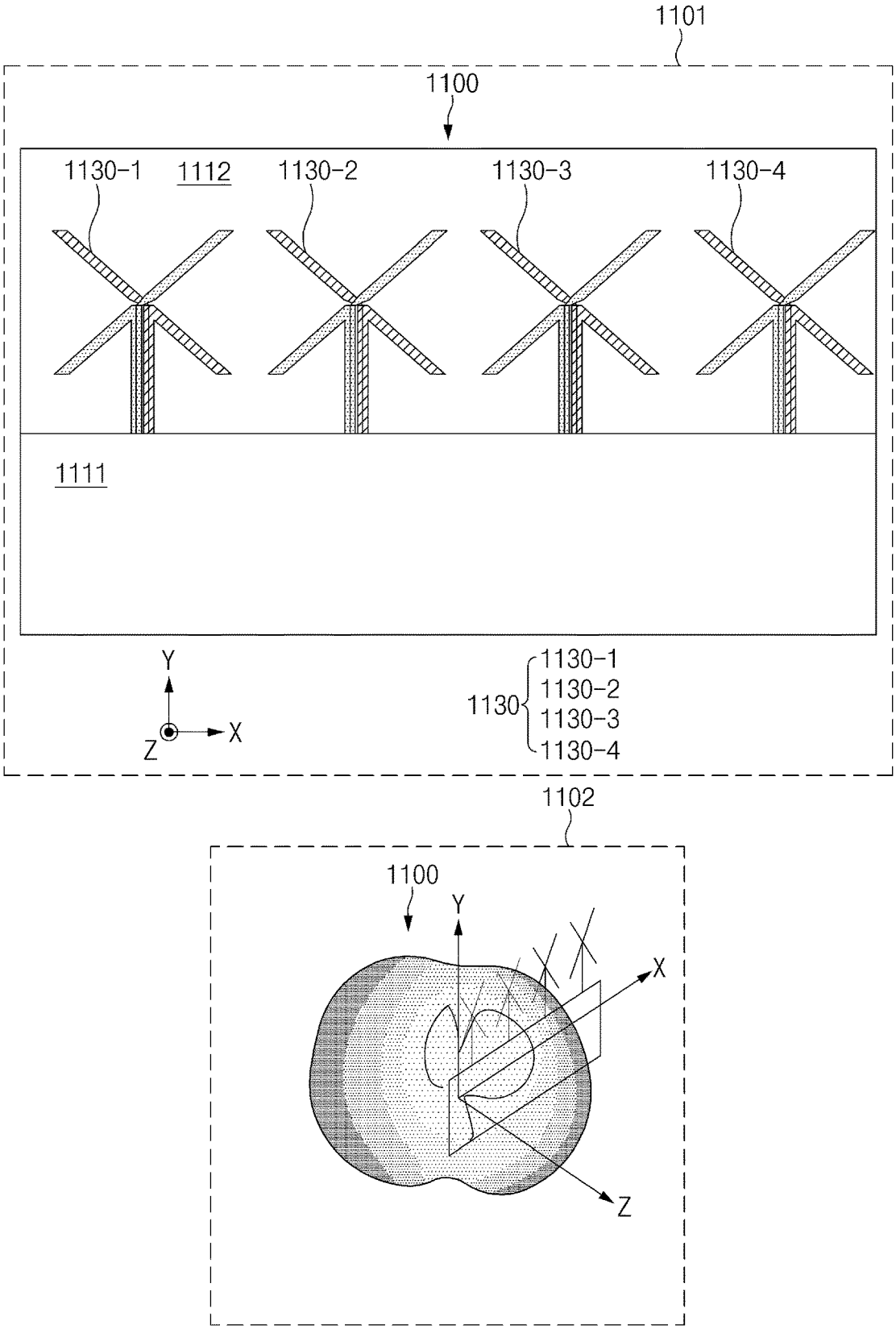
FIG. 11 illustrates a radiation pattern of a second-type antenna structure including a plurality of antenna elements according to an embodiment of the disclosure.

FIG. 11 illustrates a radiation pattern of a second-type antenna structure 1100 including a plurality of antenna elements 1130-1, 1130-2, 1130-3, and 1130-4 according to an embodiment of the disclosure.

Referring to reference numeral 1101 of FIG. 11, the antenna structure 1100 may include a first region 1111, which forms at least a portion of a printed circuit board, or a second region 1112. The first region 1111 may include, for example, a structure identical or similar to that of the first region 511 of FIG. 5A, and the second region 1112 may include a structure identical or similar to that of the second region 512 of FIG. 5A. In an embodiment, the second region 1112 may include a non-conductive region. According to an embodiment, an edge (or a boundary line) forming the first region 1111 and the second region 1112 may be a boundary of a module forming the antenna structure 1100.

According to an embodiment, the plurality of antenna elements 1130-1, 1130-2, 1130-3, and 1130-4 may be formed in the second region 1112. The plurality of antenna elements 1130-1, 1130-2, 1130-3, and 1130-4 may include a structure identical or similar to that of the antenna element 930 of FIG. 5A. The plurality of antenna elements 1130-1, 1130-2, 1130-3, and 1130-4 may form an antenna array 1130. FIG. 11 shows the antenna array 1130 forming a 1×4 pattern, but the number of antenna elements forming the antenna array 1130 and a pattern of the antenna array 1130 are not limited to the example illustrated in FIG. 11.

Referring to reference numeral 1102 of FIG. 11, the antenna structure 1100 including the antenna array 1130 may form beams in opposite directions (e.g., the positive direction of the z-axis and the negative direction of the z-axis) perpendicular to a plane where the antenna array 1130 is formed or to a plane (e.g., an xy plane) where the first region 1111 is formed.

Figure 12:
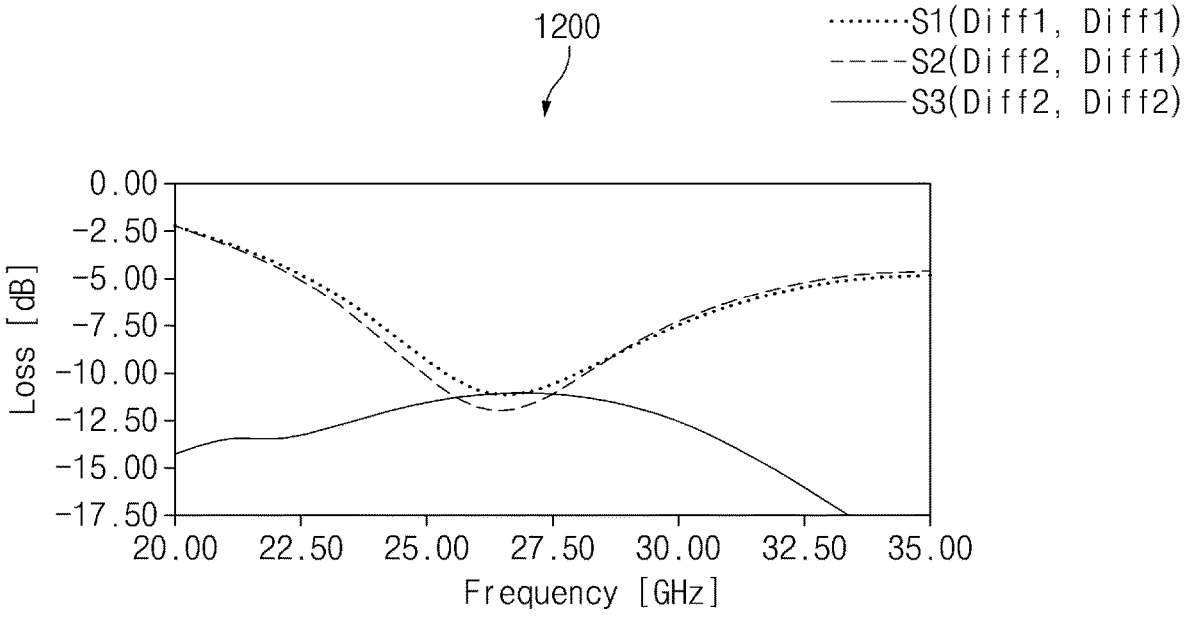
FIG. 12 illustrating a graph indicating a resonance characteristic of an antenna structure of a second type according to an embodiment of the disclosure.

FIG. 12 illustrating a graph 1200 indicating a resonance characteristic of an antenna structure (e.g., 900 of FIG. 9A) of a second type according to an embodiment of the disclosure.

Referring to FIG. 12, in graph 1200, a horizontal axis represents a frequency (in units of gigahertz (GHz)), and a vertical axis represents a loss (in units of decibel (dB)). S1(Diff1, Diff1) and S3(Diff2, Diff2) may indicate a change of a return loss according to a frequency, and S2(Diff1, Diff2) may indicate a change of an insertion loss according to a frequency. Referring to graph 1200, S1(Diff1, Diff1) being the return loss of the third dipole antenna 906 and S3(Diff2, Diff2) being the return loss of the fourth dipole antenna 907 may have a resonance characteristic in a 27 GHz band, and the isolation between the third dipole antenna 906 and the fourth dipole antenna 907 may be secured at −10 dB or less.

Figure 13:
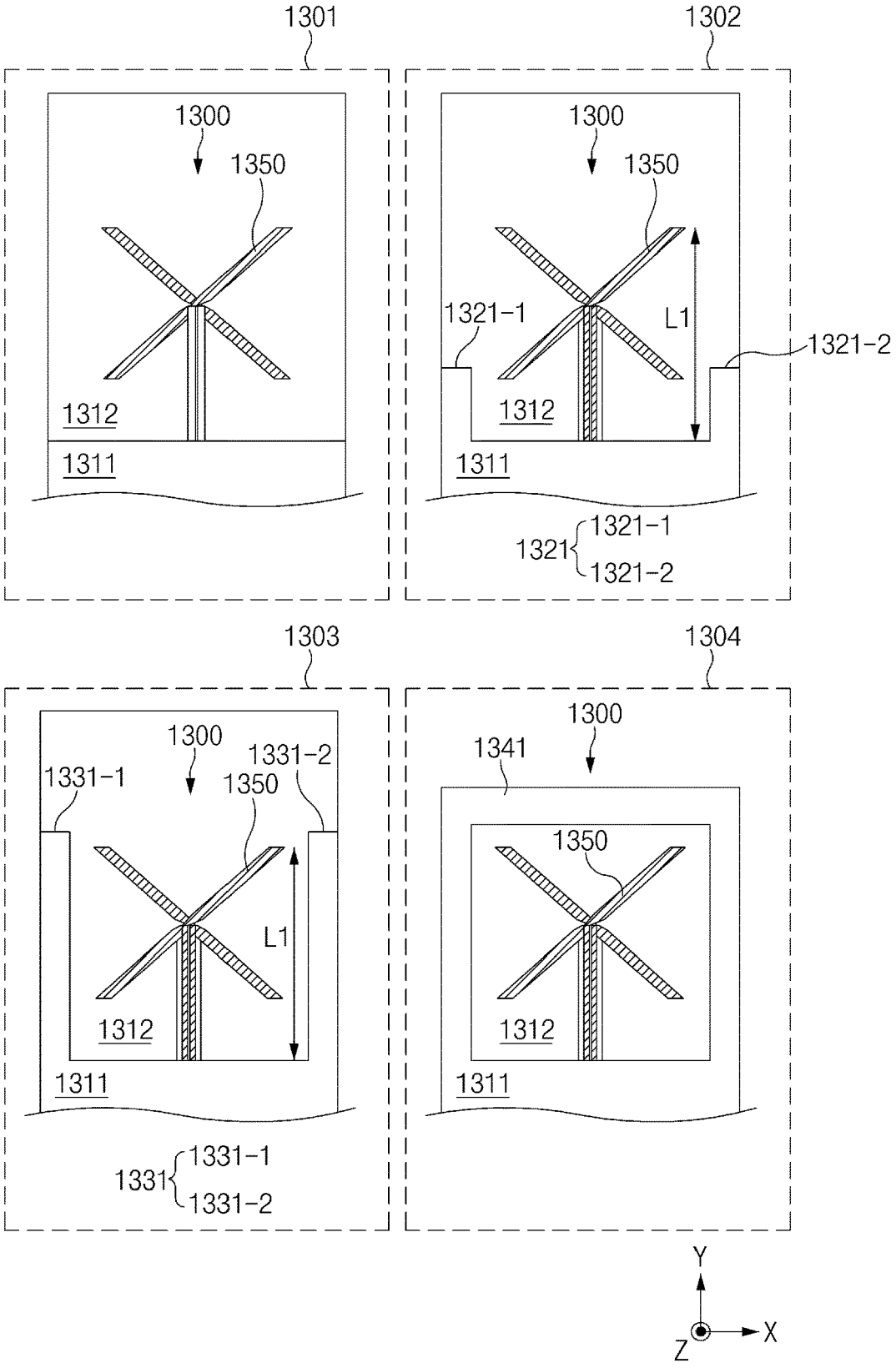
FIG. 13 is a plan view of an antenna structure in which a first region is expanded, according to an embodiment of the disclosure.

FIG. 13 is a plan view of an antenna structure 1300 in which a first region 1311 is expanded, according to an embodiment of the disclosure.

Referring to FIG. 13, the antenna structure 1300 corresponding to reference numeral 1301 may have a structure identical or similar to that of the antenna structure 500 of FIG. 5A or the antenna structure 900 of FIG. 9A. For example, an antenna element 1350 may have a structure identical or similar to that of the antenna element 550 of FIG. 5A or the antenna element 930 of FIG. 9A. The first region 1311 may correspond to the first region 511 (e.g., a conductive region or a ground region) of FIG. 5A, and a second region 1312 may correspond to the second region 512 (e.g., a fill-cut region) of FIG. 5A. FIG. 13 is a view illustrating one of antenna elements included in the antenna structure 1300, when viewed in the z-axis direction.

Referring to reference numeral 1302 according to an embodiment, the antenna structure 1300 may further include a first conductive region 1321 in which at least a portion of the first region 1311 is extended on the xy plane. For example, the first conductive region 1321 may include a first protrusion 1321-1 that is extended from one side of the antenna element 1350 (e.g., a side facing a negative direction of the x-axis), and a second protrusion 1321-2 that is extended from another side of the antenna element 1350 (e.g., a side facing a positive direction of the x-axis). A length of the first protrusion 1321-1 and a length of the second protrusion 1321-2 may be shorter than a length L1 of the antenna element 1350 in the y-axis direction on the xy plane. According to an embodiment, the length of the first protrusion 1321-1 may be substantially identical to the length of the second protrusion 1321-2.

Referring to reference numeral 1303 according to an embodiment, the antenna structure 1300 may further include a second conductive region 1331 in which at least a portion of the first region 1311 is extended on the xy plane. For example, the second conductive region 1331 may include a third protrusion 1331-1 that is extended from one side of the antenna element 1350 (e.g., a side facing the negative direction of the x-axis), and a fourth protrusion 1331-2 that is extended from another side of the antenna element 1350 (e.g., a side facing the positive direction of the x-axis). A length of the third protrusion 1331-1 and a length of the fourth protrusion 1331-2 may be substantially identical to or longer than the length L1 of the antenna element 1350 in the y-axis direction on the xy plane. According to an embodiment, the length of the third protrusion 1331-1 may be substantially identical to the length of the fourth protrusion 1331-2.

Referring to reference numeral 1304 according to an embodiment, the antenna structure 1300 may further include a third conductive region 1341 surrounding a nearby region of the antenna element 1350 (e.g., three surfaces of the antenna element 1350 except for a surface corresponding to the first region 1311) on the xy plane.

According to an embodiment, at least one of the first conductive region 1321, the second conductive region 1331, or the third conductive region 1341 may include the ground region. In this case, at least one of an integrated circuit (IC) device or a lumped element of an electronic device (e.g., 101 of FIG. 1) may be disposed in at least one of the first conductive region 1321, the second conductive region 1331, or the third conductive region 1341. For example, as illustrated in FIG. 4, an RFIC (e.g., the RFIC 452 of FIG. 4) may be disposed at a portion of the first region 1311 (e.g., a portion of the printed circuit board 410 in 400*b* of FIG. 4), and the RFIC may be connected with the antenna element 1350 through a feeding line. For another example, at least one of surface-mount devices (SMD), molding, or shielding may be applied to at least one of the first conductive region 1321, the second conductive region 1331, or the third conductive region 1341.

Figure 14:
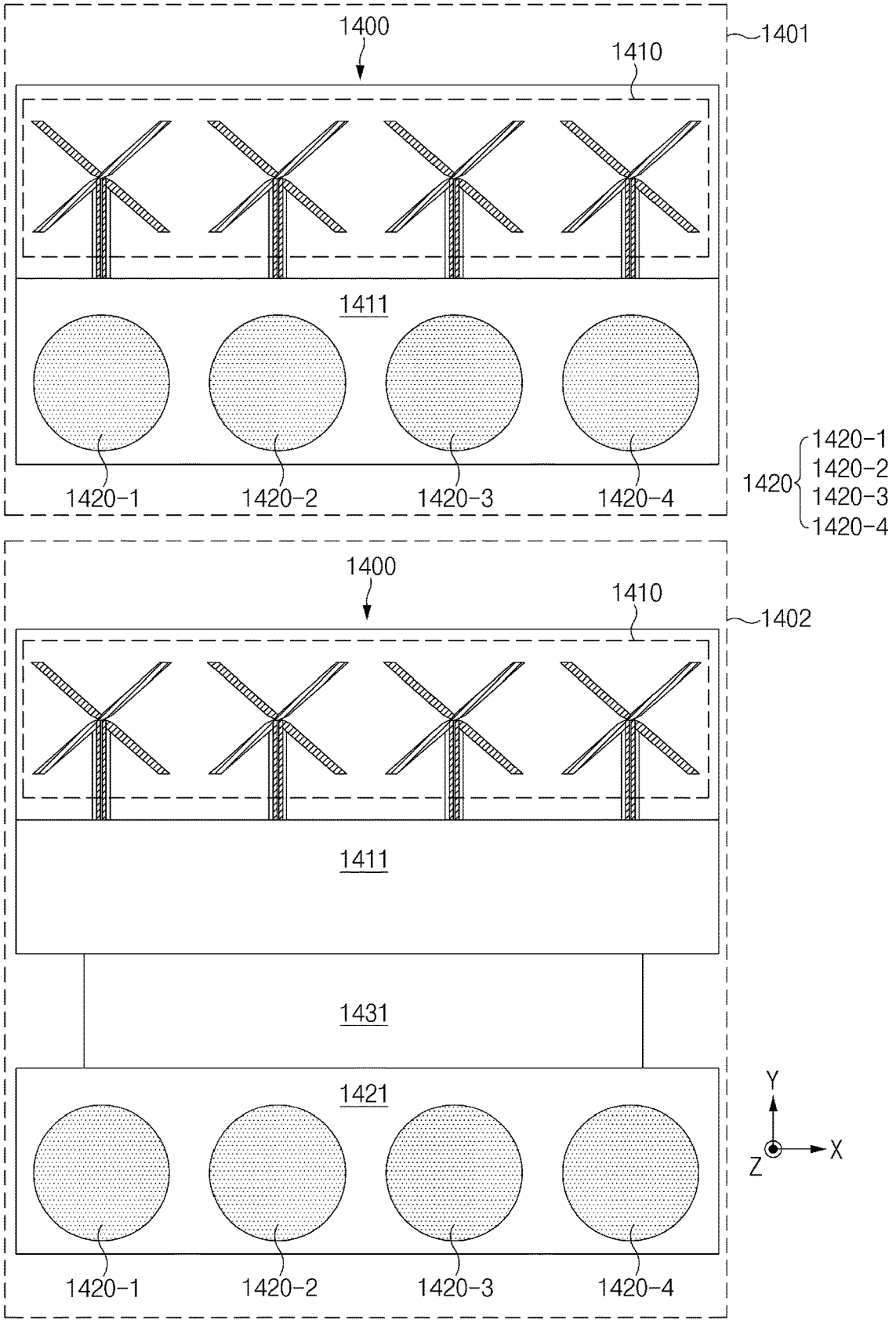
FIG. 14 illustrates an antenna structure including a first antenna array and a second antenna array according to an embodiment of the disclosure.

FIG. 14 illustrates an antenna structure 1400 including a first antenna array 1410 and a second antenna array 1420 according to an embodiment of the disclosure.

Referring to FIG. 14, the antenna structure 1400 may further include the second antenna array 1420 in addition to the antenna structure 500 illustrated in FIG. 5A or the antenna structure 900 illustrated in FIGS. 9A and 9B. For example, referring to reference numeral 1401 according to an embodiment, the antenna structure 1400 may further include the first antenna array 1410 and the second antenna array 1420 at at least a portion of the same PCB (e.g., a first PCB 1411). The first antenna array 1410 may correspond to at least one of the antenna array 750 of FIG. 7 or the antenna array 1130 of FIG. 11. The second antenna array 1420 may include, for example, a plurality of patch antenna elements (e.g., at least one of 1420-1, 1420-2, 1420-3, or 1420-4). For another example, referring to reference numeral 1402 according to an embodiment, the antenna structure 1400 may further include the first antenna array 1410 and the second antenna array 1420 on different PCBs. For example, the first antenna array 1410 may be disposed at the first PCB 1411, and the second antenna array 1420 may be disposed at a second PCB 1421. In this case, the first PCB 1411 and the second PCB 1421 may be connected through a connection member 1431. The connection member 1431 may include, for example, a coaxial cable connector, a board to board connector, an interposer, or a flexible printed circuit board (FPCB).

Figure 15A:
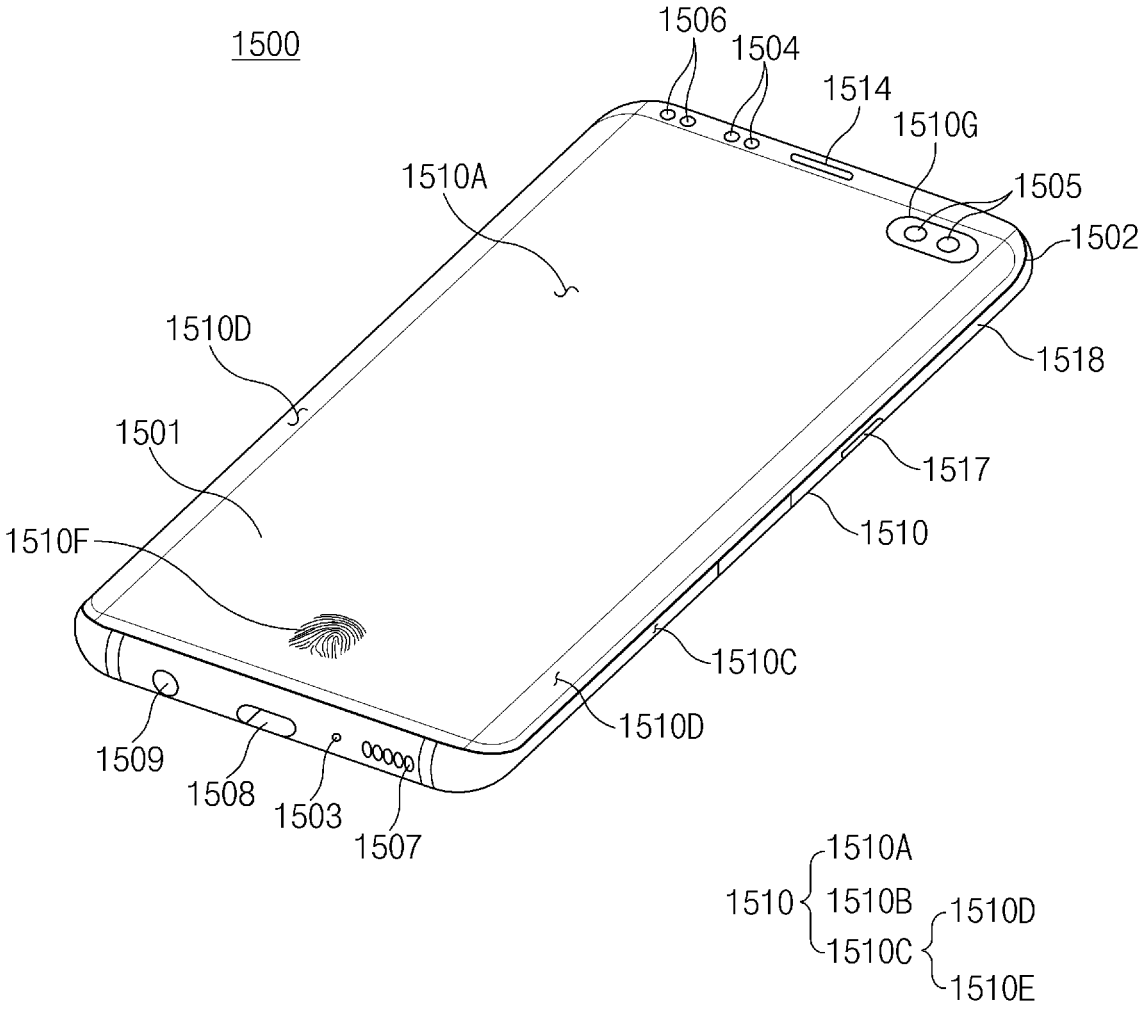
FIG. 15A is a front perspective view of a mobile electronic device according to an embodiment of the disclosure.

FIG. 15A is a front perspective view of a mobile electronic device 1500 according to an embodiment of the disclosure.

Figure 15B:
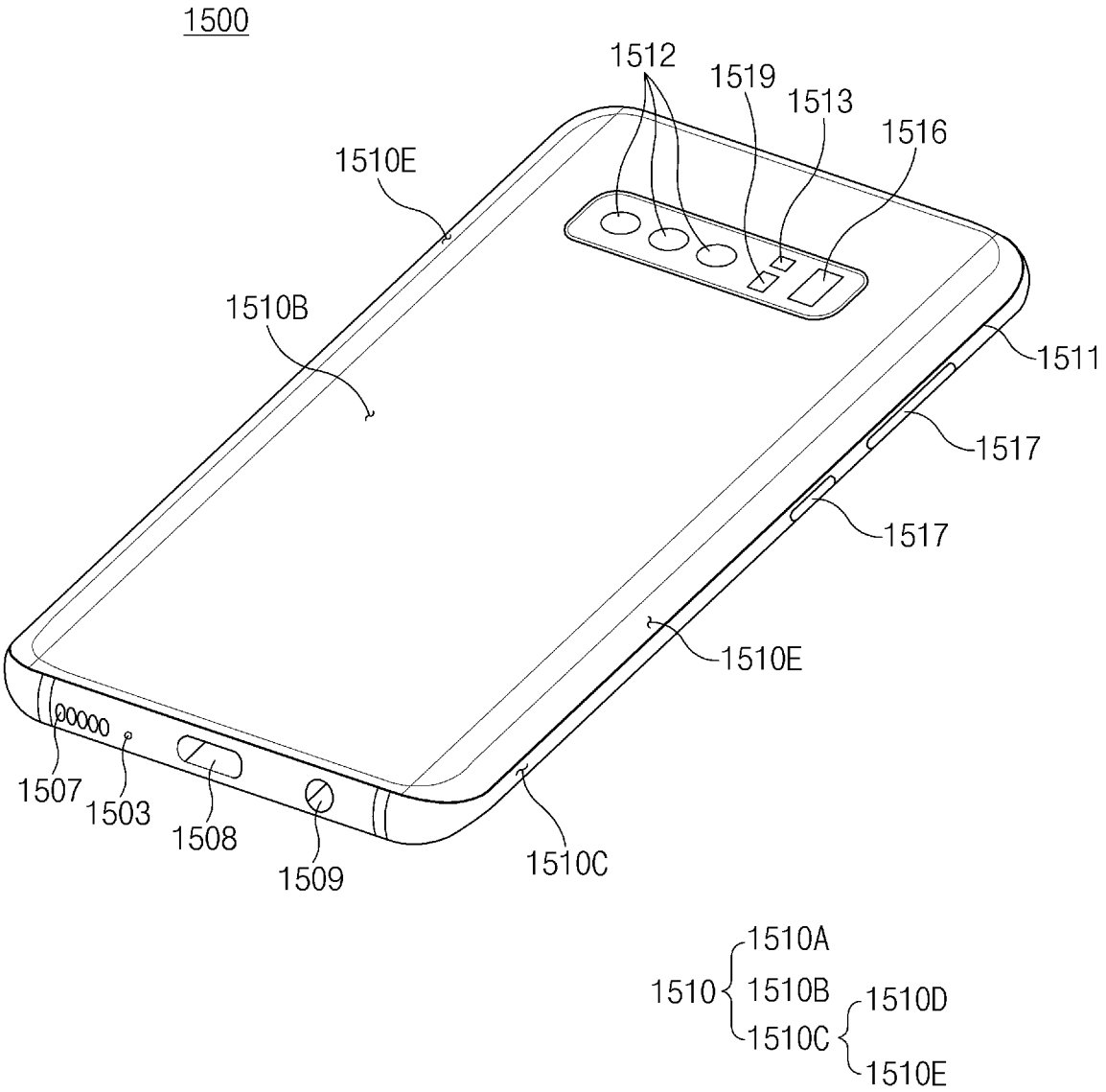
FIG. 15B is a back perspective view of a mobile electronic device illustrated in FIG. 15A according to an embodiment of the disclosure.

FIG. 15B is a back perspective view of the mobile electronic device 1500 illustrated in FIG. 15A according to an embodiment of the disclosure.

Referring to FIGS. 15A and 15B, the electronic device 1500 (e.g., the electronic device 101 of FIG. 1) according to an embodiment may include a housing 1510 that includes a first surface (or a front surface) 1510A, a second surface (or a back surface) 1510B, and a side surface 1510C surrounding a space between the first surface 1510A and the second surface 1510B.

In another embodiment (not illustrated), the housing 1510 may be referred to as a "structure" that forms a portion of the first surface 1510A, the second surface 1510B, and the side surface 1510C of FIG. 15A.

According to an embodiment, the first surface 1510A may be implemented with a front plate 1502 (e.g., a glass plate including various coating layers, or a polymer plate), at least a portion of which is substantially transparent. The second surface 1510B may be formed by a back plate 1511 that is substantially opaque. For example, the back plate 1511 may be formed by a coated or colored glass, a ceramic, a polymer, a metal (e.g., aluminum, stainless steel (STS), or magnesium), or a combination of at least two of the materials. The side surface 1510C may be coupled to the front plate 1502 and the back plate 1511, and may be formed by a side bezel structure (or a "side member") 1518 including a metal and/or a polymer.

In any embodiment, the back plate 1511 and the side bezel structure 1518 may be integrally formed and may include the same material (e.g., a metal material such as aluminum).

In the embodiment that is illustrated, the front plate 1502 may include two first regions 1510D, which are curved toward the back plate 1511 from the first surface 1510A so as to be seamlessly extended, at opposite long edges of the front plate 1502.

In the embodiment that is illustrated (refer to FIG. 15B), the back plate 1511 may include two second regions 1510E, which are curved toward the front plate 1502 from the second surface 1510B so as to be seamlessly extended, at opposite long edges of the back plate 1511.

In an embodiment, the front plate 1502 (or the back plate 1511) may include only one of the first regions 1510D (or the second regions 1510E). In another embodiment, the front plate 1502 (or the back plate 1511) may not include a part of the first regions 1510D (or the second regions 1510E).

In the embodiments, when viewed from one side of the electronic device 1500, the side bezel structure 1518 may have a first thickness (or width) on one side (e.g., a short side) where the first regions 1510D or the second regions 1510E are not included, and may have a second thickness smaller than the first thickness on one side (e.g., a long side) where the first regions 1510D or the second regions 1510E are included.

According to an embodiment, the electronic device 1500 may include at least one or more of a display 1501, an audio module (1503, 1507, 1514) (e.g., at least a portion of the audio module 170 of FIG. 1), a sensor module (1504, 1516, 1519) (e.g., at least a portion of the sensor module 176 of FIG. 1), a camera module (1505, 1512, 1513) (e.g., at least a portion of the camera module 180 of FIG. 1), a key input device 1517, a light-emitting device 1506, and a connector hole (1508, 1509). In any embodiment, the electronic device 1500 may not include at least one (e.g., the key input device 1517 or the light-emitting device 1506) of the components or may further include any other component.

The display 1501 (e.g., at least a portion of the display device 160 of FIG. 1) may be exposed, for example, through a considerable portion of the front plate 1502. In an embodiment, at least a portion of the display 1501 may be exposed through the first surface 1510A and the front plate 1502 including the first regions 1510D of the side surface 1510C.

In an embodiment, a corner of the display 1501 may be formed to be mostly identical to a shape of an outer portion of the front plate 1502, which is adjacent thereto. In another embodiment (not illustrated), to increase the area where the display 1501 is exposed, an interval between an outer portion of the display 1501 and an outer portion of the front plate 1502 may be formed mostly identically.

In an embodiment, a surface of the housing 1510 (or the front plate 1502) may include a screen display region that is formed as the display 1501 is visually exposed. For example, the screen display region may include the first surface 1510A, and the first regions 1510D of the side surface 1510C.

In the embodiment that is illustrated, the screen display region (1510A, 1510D) may include a sensing region 1510F configured to obtain biometric information of a user. Here, the expression "the screen display region (1510A, 1510D) includes a sensing region 1510F" may be understood as at least a portion of the sensing region 1510F overlaps the screen display region (1510A, 1510D). In other words, like the remaining portion of the screen display region (1510A, 1510D), the sensing region 1510F may display visual information by the display 1501, and in addition, may mean a region capable of obtaining biometric information (e.g., a fingerprint) of the user.

In the embodiment that is illustrated, the screen display region (1510A, 1510D) of the display 1501 may include a region 1510G where the first camera device 1505 (e.g., a punch through camera) is capable of being visually exposed. At least a portion of a periphery of the region 1510G where the first camera device 1505 is exposed may be surrounded by the screen display region (1510A, 1510D). In various embodiments, the first camera device 1505 may include a plurality of camera devices.

In another embodiment (not illustrated), a recess or an opening may be formed at a portion of the screen display region (1510A, 1510D) of the display 1501, and at least one or more of the audio module 1514, the first sensor module 1504, and the light-emitting device 1506 that are aligned with the recess or the opening may be included therein.

In another embodiment (not illustrated), the display 1501 may include at least one or more of the audio module 1514, the sensor module (1504, 1516, 1519), and the light-emitting device 1506 below the screen display region (1510A, 1510D).

In another embodiment (not illustrated), the display 1501 may be combined with a touch sensing circuit, a pressure sensor capable of measuring the intensity (or pressure) of a touch, and/or a digitizer capable of detecting a magnetic stylus pen or may be disposed adjacent thereto.

In an embodiment, at least a portion of the sensor module (1504, 1516, 1519) and/or at least a portion of the key input device 1517 may be disposed on the side surface 1510C (e.g., the first regions 1510D and/or the second regions 1510E).

The audio module (1503, 1507, 1514) may include the microphone hole 1503 and the speaker hole (1507, 1514). A microphone for obtaining external sound may be disposed within the microphone hole 1503; in an embodiment, a plurality of microphones may be disposed to detect a direction of sound. The speaker hole (1507, 1514) may include the external speaker hole 1507 and the receiver hole 1514 for call. In an embodiment, the speaker hole (1507, 1514) and the microphone hole 1503 may be implemented with one hole, or a speaker (e.g., a piezoelectric speaker) may be included without the speaker hole (1507, 1514).

The sensor module (1504, 1516, 1519) may generate an electrical signal or a data value that corresponds to an internal operation state of the electronic device 1500 or corresponds to an external environment state. The sensor module (1504, 1516, 1519) may include, for example, the first sensor module 1504 (e.g., a proximity sensor) disposed on the first surface 1510A of the housing 1510, the second sensor module 1506 (e.g., a time-of-flight (ToF) camera device) disposed on the second surface 1510B of the housing 1510, the third sensor module 1519 (e.g., a hear rate monitor (HRM) sensor) disposed on the second surface 1510B of the housing 1510, and/or a fourth sensor module (e.g., a sensor 1590 of FIG. 15C) (e.g., a fingerprint sensor) coupled to the display 1501.

In various embodiments, the second sensor module 1516 may include a ToF camera device for measuring a distance.

In various embodiments, at least a portion of the fourth sensor module (e.g., the sensor 1590 of FIG. 15C) may be disposed below the screen display region (1510A, 1510D). For example, the fourth sensor module may be disposed in the recess (e.g., a recess 1539 of FIG. 15C) formed on a back surface of the display 1501. That is, the fourth sensor module (e.g., the sensor 1590 of FIG. 15C) may not be exposed through the screen display region (1510A, 1510D) and may form the sensing region 1510F at at least a portion of the screen display region (1510A, 1510D).

In an embodiment (not illustrated), the fingerprint sensor may be disposed on the second surface 1510B as well as the first surface 1510A (e.g., the screen display region (1510A, 1510D)) of the housing 1510.

In various embodiments, the electronic device 1500 may further include a sensor module not illustrated, for example, at least one of a gesture sensor, a gyro sensor, a barometric pressure sensor, a magnetic sensor, an acceleration sensor, a grip sensor, a color sensor, an infrared (IR) sensor, a biometric sensor, a temperature sensor, a humidity sensor, or an illumination sensor.

The camera module (1505, 1512, 1513) may include the first camera device 1505 (e.g., a punch through camera device) exposed through the first surface 1510A of the electronic device 1500, and the second camera module 1512 and/or the flash 1513 exposed through the second surface 1510B.

In the embodiment that is illustrated, the first camera device 1505 may be exposed through a portion of the first surface 1510A belonging to the screen display region (1510A, 1510D). For example, the first camera device 1505 may be exposed through an opening (not illustrated) formed at a portion of the display 1501 as a partial region of the screen display region 1510A.

In the embodiment that is illustrated, the second camera device 1512 may include a plurality of camera devices (e.g., a dual camera or a triple camera). However, the second camera device 1512 is not limited to the above example where a plurality of camera devices are included therein. For example, the second camera device 1512 may include one camera device.

The camera devices 1505 and 1512 may include one or more lenses, an image sensor, and/or an image signal processor. The flash 1513 may include, for example, a light-emitting diode or a xenon lamp. In an embodiment, two or more lenses (e.g., an infrared camera and wide-angle and telephoto lenses) and image sensors may be disposed on one surface of the electronic device 1500.

The key input device 1517 may be disposed on the side surface 1510C of the housing 1510. In another embodiment, the electronic device 1500 may not include the key input device 1517 or a portion of the key input device 1517, and a key input device not included therein may be implemented on the display 1501 in the form of a soft key. In an embodiment, a key input device may include a sensor module (e.g., the sensor 1590 of FIG. 15C) forming the sensing region 1510F included in the screen display region (1510A, 1510D).

The light-emitting device 1506 may be disposed, for example, on the first surface 1510A of the housing 1510. The light-emitting device 1506 may provide status information of the electronic device 1500, for example, in the form of light. In another embodiment, the light-emitting device 1506 may provide, for example, a light source that operates in conjunction with an operation of the first camera module 1505. The light-emitting device 1506 may include, for example, a light-emitting diode (LED), an IR LED, and a xenon lamp.

The connector hole (1508, 1509) may include the first connector hole 1508 capable of accommodating a connector (e.g., a USB connector) for transmitting/receiving a power and/or data with an external electronic device, and/or the second connector hole (or an earphone jack) 1509 capable of accommodating a connector for transmitting/receiving an audio signal with the external electronic device.

Figure 15C:
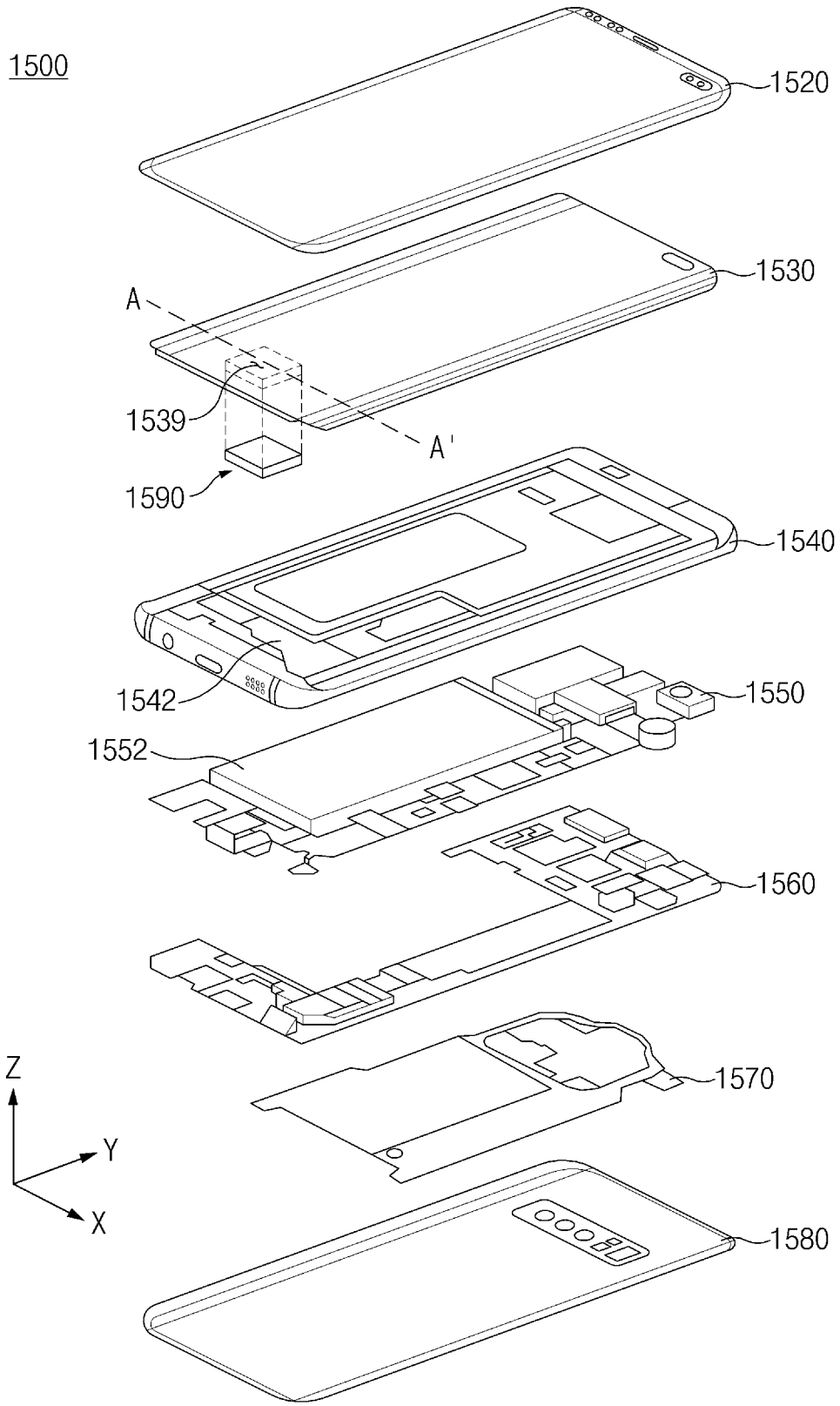
FIG. 15C is an exploded perspective view of a mobile electronic device illustrated in FIG. 15A according to an embodiment of the disclosure.

FIG. 15C is an exploded perspective view of the mobile electronic device 1500 illustrated in FIG. 15A according to an embodiment of the disclosure.

Referring to FIG. 15C, the electronic device 1500 may include a side member 1540, a first support member 1542 (e.g., a bracket), a front plate 1520, a display 1530 (e.g., the display 1501 of FIG. 15A), a printed circuit board 1550 (e.g., the printed circuit board 410 of FIG. 3), a battery 1552 (e.g., the battery 189 of FIG. 1), a second support member 1560 (e.g., a rear case), an antenna 1570, and a back plate 1580. In an embodiment, the electronic device 1500 may not include at least one (e.g., the first support member 1542 or the second support member 1560) of the components or may further include any other component. At least one of the components of the electronic device 1500 may be identical or similar to at least one of the components of the electronic device 1500 of FIG. 15A or 15B, and thus, additional description will be omitted to avoid redundancy.

The first support member 1542 may be disposed within the electronic device 1500 so as to be connected with the side member 1540, or may be integrally formed with the side member 1540. The first support member 1542 may be formed of, for example, a metal material and/or a nonmetal material (e.g., a polymer). The display 1530 may be coupled to one surface of the first support member 1542, and the printed circuit board 1550 may be coupled to an opposite surface of the first support member 1542. A processor, a memory, and/or an interface may be mounted on the printed circuit board 1550. The processor may include, for example, one or more of a central processing unit, an application processor, a graphic processing device, an image signal processor, a sensor hub processor, or a communication processor.

The memory may include, for example, a volatile memory or a nonvolatile memory.

The interface may include, for example, a high definition multimedia interface (HDMI), a universal serial bus (USB) interface, a secure digital (SD) card interface, and/or an audio interface. The interface may electrically or physically connect, for example, the electronic device 1500 with an external electronic device and may include a USB connector, an SD card/MMC connector, or an audio connector.

The battery 1552 that is a device for supplying a power to at least one component of the electronic device 1500 may include, for example, a primary cell incapable of being recharged, a secondary cell rechargeable, or a fuel cell. At least a portion of the battery 1552 may be disposed on substantially the same plane as the printed circuit board 1550, for example. The battery 1552 may be integrally disposed within the electronic device 1500 or may be disposed to be removable from the electronic device 1500.

The antenna 1570 may be interposed between the back plate 1580 and the battery 1552. The antenna 1570 may include, for example, a near field communication (NFC) antenna, an antenna for wireless charging, and/or a magnetic secure transmission (MST) antenna. For example, the antenna 1570 may perform short range communication with an external device or may wirelessly transmit/receive a power necessary to charge. In another embodiment, an antenna structure may be implemented with a portion of the side member 1540 and/or the first support member 1542, or with a combination thereof.

In the embodiment that is illustrated, the electronic device 1500 may further include the sensor 1590 coupled to the display 1530. The sensor 1590 may be disposed in a recess 1539 formed on a back surface of the display 1530. The sensor 1590 may form a sensing region (e.g., the sensing region 1510F) at a portion of the front plate 1520.

Figure 16A:
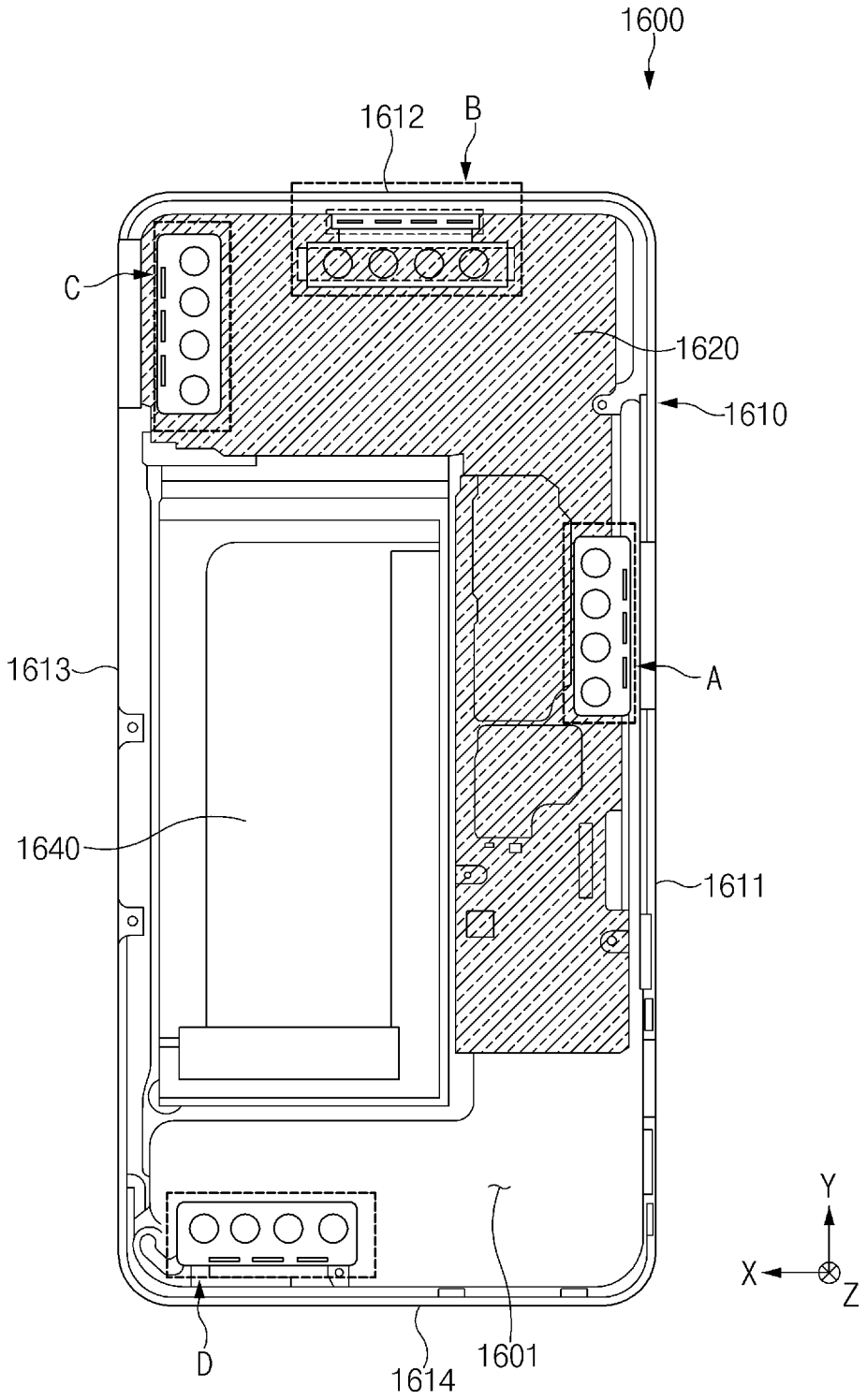
FIG. 16A is a view illustrating a placement relationship in which a third antenna module is disposed at a mobile electronic device according to an embodiment of the disclosure.

FIG. 16A is a view illustrating a placement relationship in which the third antenna module 246 is disposed at a mobile electronic device 1600 according to an embodiment of the disclosure.

Figure 16B:
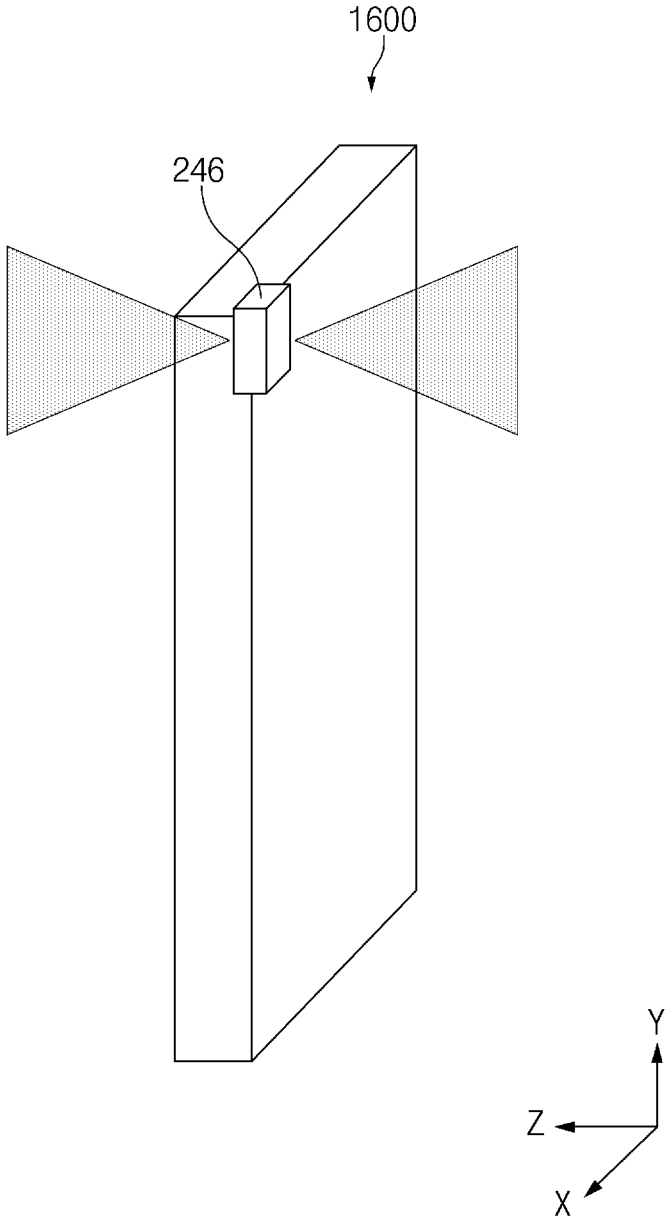
FIG. 16B illustrates one example of a radiation pattern of an antenna module disposed at a mobile electronic device according to an embodiment of the disclosure.

FIG. 16B illustrates a beam pattern of the third antenna module 246 disposed at the mobile electronic device 1600 according to an embodiment of the disclosure.

A shape of a beam pattern of the third antenna module 246 may not be limited to examples illustrated in FIGS. 16A to 20 and may be identical or similar to the shape illustrated in FIG. 7 or 11.

Referring to FIG. 16A, the electronic device 1600 (e.g., the mobile electronic device 1500 of FIG. 15A) may include a side member 1610 (e.g., the side member 1540 of FIG. 15C). According to an embodiment, the side member 1610 may include a first side surface 1611 that is formed with a first length, a second side surface 1612 that is extended from the first side surface 1611 in a direction perpendicular to the first side surface 1611 and has a second length shorter than the first length, a third side surface 1613 that is extended from the second side surface 1612 in a direction parallel to the first side surface 1611 and has the first length, and a fourth side surface 1614 that is extended from the third side surface 1613 in a direction parallel to the second side surface 1612 and has the second length. According to an embodiment, the electronic device 1600 may include a battery 1640 (e.g., the battery 189 of FIG. 1 or the battery 1552 of FIG. 15C) and a device substrate 1620 (e.g., at least a portion of the second support member 1560 of FIG. 15C) in an inner space 1601, and the device substrate 1620 may be disposed not to overlap the battery 1640 or to at least partially overlap the battery 1640.

According to an embodiment, the third antenna module 246 including the antenna structures illustrated in FIGS. 5A to 14 may be disposed in the inner space 1601 in various directions and may be electrically connected with the device substrate 1620. For example, the third antenna module 246 may be disposed in the vicinity of the first side surface 1611 (e.g., location "A"), in the vicinity of the second side surface 1612 (e.g., location "B"), in the vicinity of the third side surface 1613 (e.g., location "C"), and/or in the vicinity of the fourth side surface 1614 (e.g., location "D"). According to an embodiment, the third antenna module 246 may be disposed in plurality.

Referring to FIG. 16B, the third antenna module 246 disposed at the electronic device 1600 may form a beam in a direction (e.g., the positive direction of the z-axis and/or the negative direction of the z-axis) perpendicular to the side member 1610 or may radiate a signal in the direction.

Figure 17:
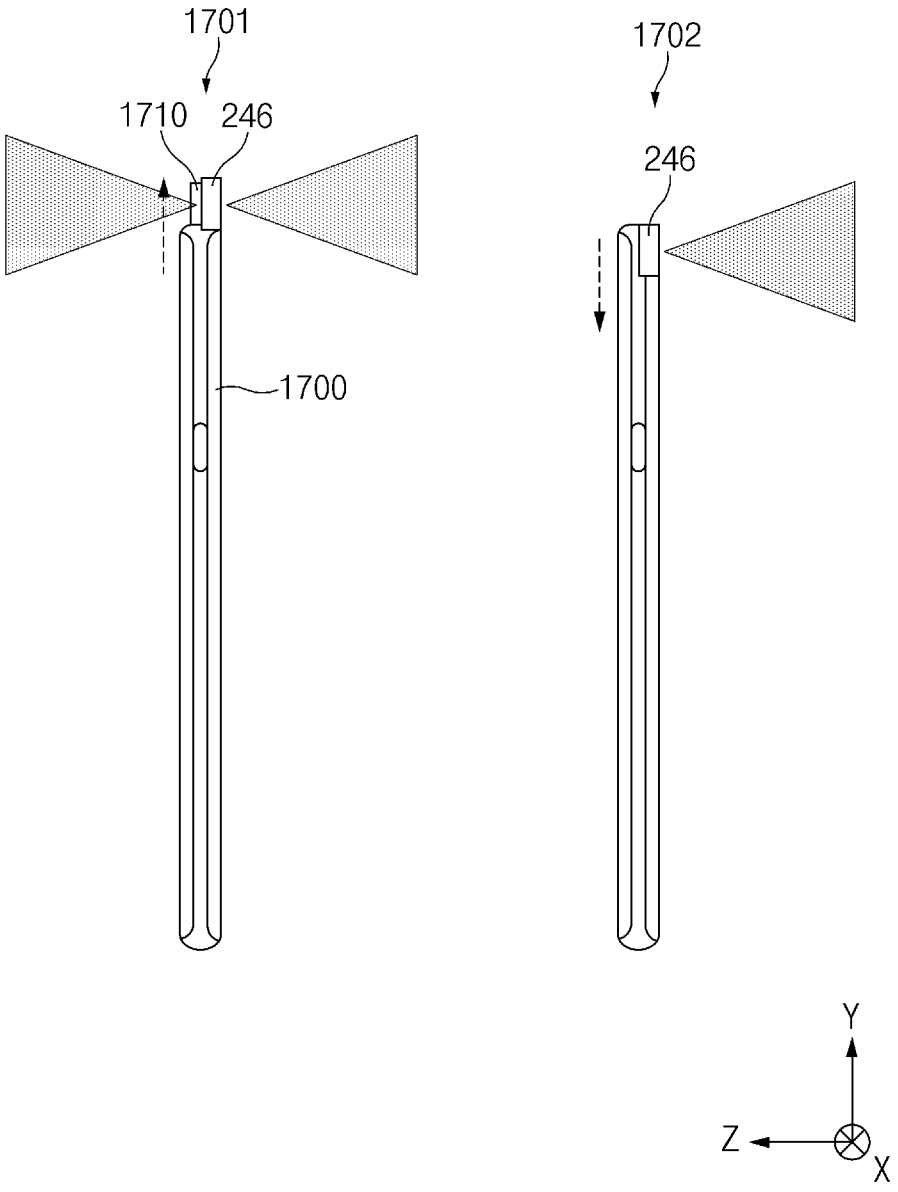
FIG. 17 illustrates another example of a radiation pattern of an antenna module disposed at a mobile electronic device according to an embodiment of the disclosure.

FIG. 17 illustrates another example of a radiation pattern of the third antenna module 246 disposed at a mobile electronic device 1700 according to an embodiment of the disclosure.

Referring to FIG. 17, the electronic device 1700 may mean an electronic device that is implemented by changing a structure of a portion of the electronic device 1500 of FIGS. 15A to 15C. For example, the electronic device 1700 may further include a slide member 1710 that moves in a direction (e.g., the positive direction of the y-axis) facing a second side surface (e.g., the second side surface 1612 of FIG. 16A) and in a direction (e.g., the negative direction of the y-axis) facing a fourth side surface (e.g., the fourth side surface 1614 of FIG. 16A). According to an embodiment, the slide member 1710 may include an injection-molding structure or a glass structure.

According to an embodiment, the third antenna module 246 may be disposed on one surface of the slide member 1710 or may be disposed within the slide member 1710. Referring to reference numeral 1701, when the slide member 1710 moves in the positive direction of the y-axis, at least a portion of the slide member 1710 including the third antenna module 246 may be exposed. As such, the third antenna module 246 may radiate signals in opposite directions (e.g., the positive direction of the z-axis and the negative direction of the z-axis). Referring to reference numeral 1702, when the slide member 1710 moves in the negative direction of the y-axis, a ground wall may exist in one (e.g., the positive direction of the z-axis) of the opposite directions. As such, the third antenna module 246 may radiate a signal in the other direction (e.g., the negative direction of the z-axis).

Figure 18:
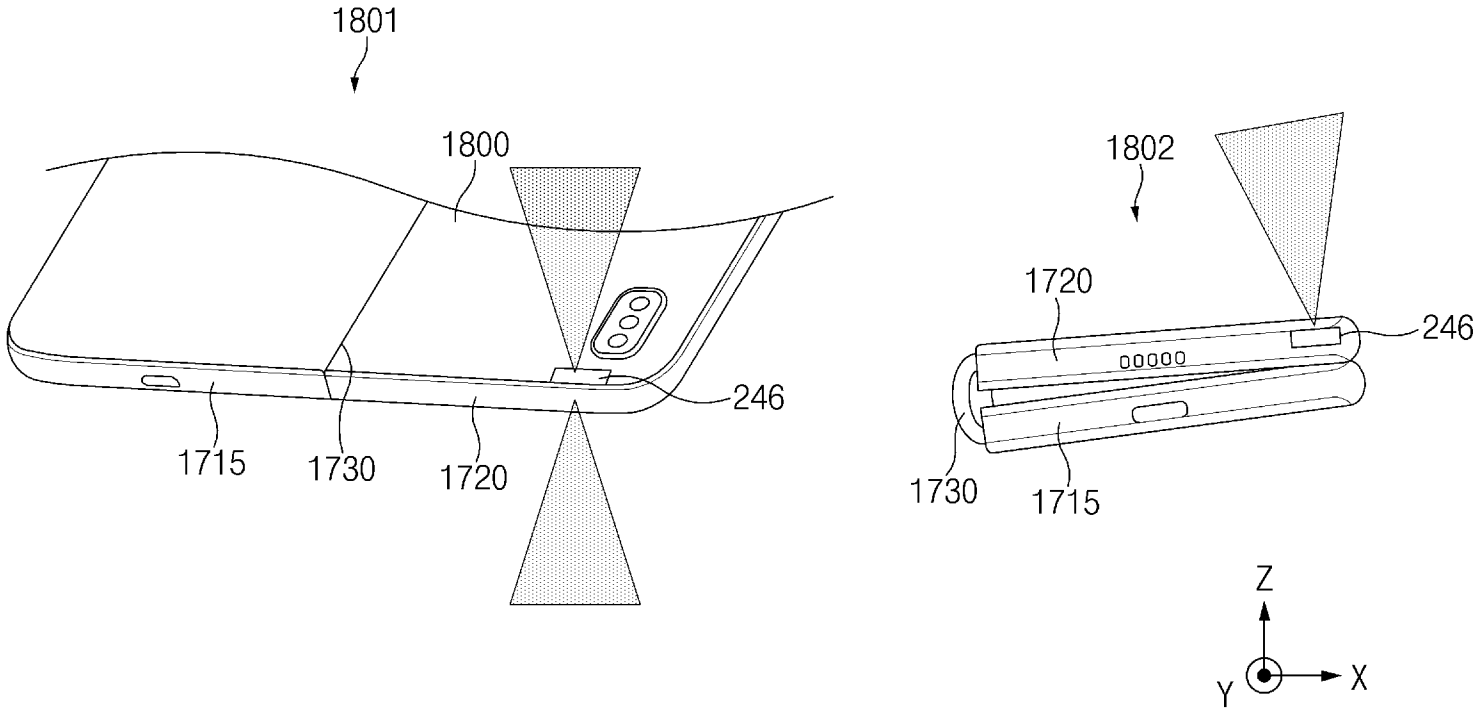
FIG. 18 illustrates another example of a radiation pattern of an antenna module disposed at a mobile electronic device according to an embodiment of the disclosure.

FIG. 18 illustrates one example of a radiation pattern of the third antenna module 246 disposed at a mobile electronic device 1800 according to an embodiment of the disclosure.

Referring to FIG. 18, the electronic device 1800 may mean an electronic device that is implemented by changing a structure of a portion of the electronic device 1500 of FIGS. 15A to 15C. For example, the electronic device 1800 may include a first housing structure 1715, a second housing structure 1720, and a connection member 1730. The first housing structure 1715 and/or the second housing structure 1720 may include at least one of the components of the electronic device 101 illustrated in FIG. 1. The first housing structure 1715 and the second housing structure 1720 may be folded or unfolded around connection member 1730.

According to an embodiment, the third antenna module 246 may be disposed on one side surface of the first housing structure 1715 or on one side surface of the second housing structure 1720, or a plurality of third antenna modules 246 may be disposed on one side surface of the first housing structure 1715 and on one side surface of the second housing structure 1720. Referring to reference numeral 1801, when the third antenna module 246 is disposed at the second housing structure 1720 and the first housing structure 1715 and the second housing structure 1720 are unfolded, the third antenna module 246 may radiate signals in opposite directions (e.g., the positive direction of the z-axis and the negative direction of the z-axis). Referring to reference numeral 1802, when the third antenna module 246 is disposed at the second housing structure 1720 and the first housing structure 1715 and the second housing structure 1720 are fully folded, a part (e.g., a signal radiated in the positive direction of the z-axis) of signals radiated from the third antenna module 246 may fail to pass through a ground wall (not illustrated) existing at the first housing structure 1715. As such, the third antenna module 246 may radiate a signal in one direction (e.g., the negative direction of the z-axis).

Figure 19:
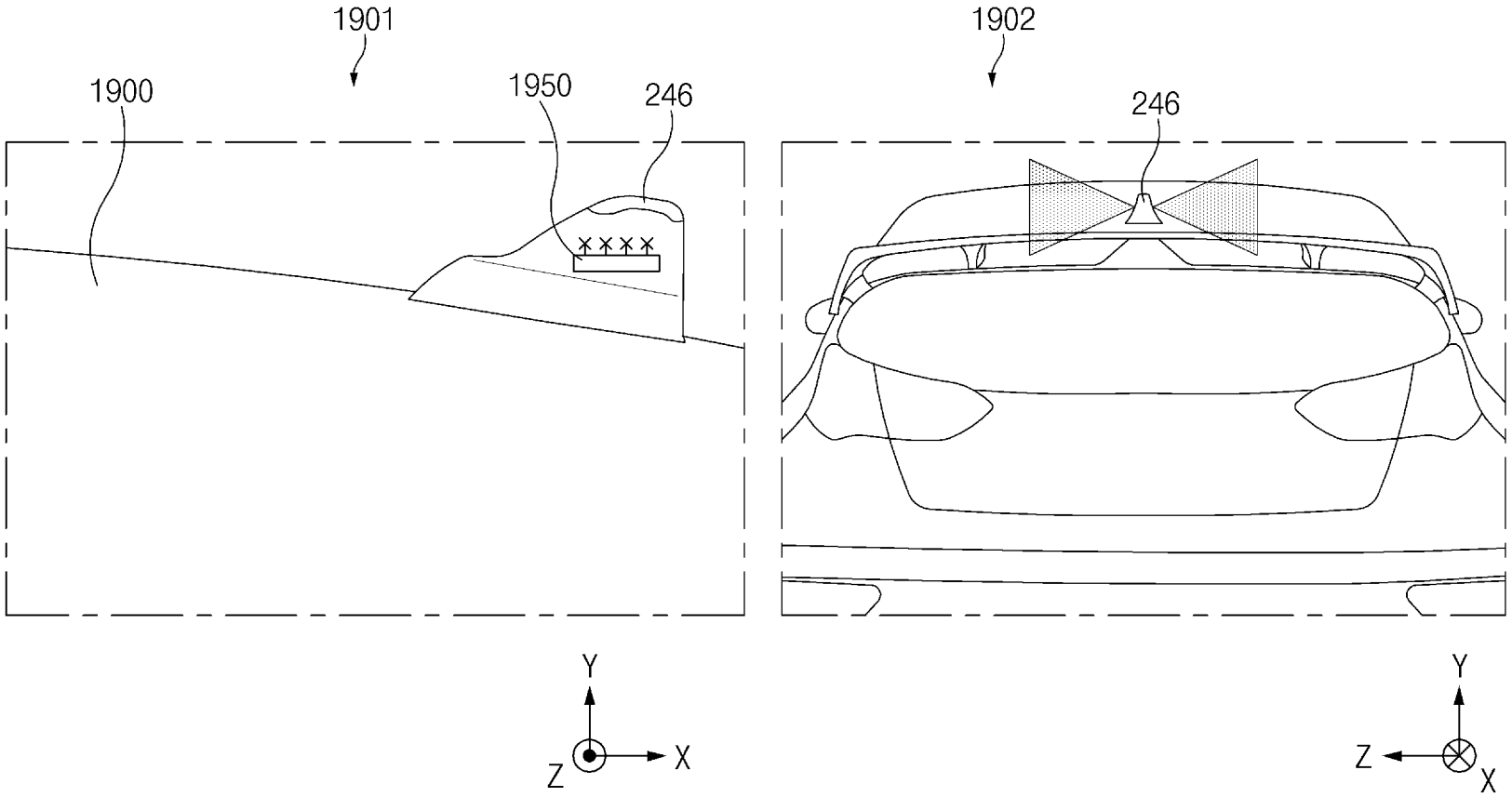
FIG. 19 illustrates an example of a radiation pattern of an antenna module disposed at a vehicle according to an embodiment of the disclosure.

FIG. 19 illustrates an example of a radiation pattern of the third antenna module 246 disposed at a vehicle 1900 according to an embodiment of the disclosure.

Referring to FIG. 19, an antenna structure 1950 included in the third antenna module 246 may have a structure identical or similar to that of the antenna structure 500 of FIG. 5A or the antenna structure 900 of FIG. 9A.

According to an embodiment, referring to reference numeral 1901 indicating the third antenna module 246 disposed at the vehicle 1900 when viewed from the side of the vehicle 1900 (e.g., in the positive direction of the z-axis), the third antenna module 246 may radiate a signal (e.g., a 5G Sub6 RF signal or a 5G Above6 RF signal) in a specified frequency band by using an antenna structure 1950. For example, referring to reference numeral 1902 indicating the third antenna module 246 disposed at the vehicle 1900 when viewed from the back of the vehicle 1900 (e.g., in the positive direction of the x-axis), the third antenna module 246 may radiate signals toward opposite sides of the vehicle 1900 (e.g., in the positive direction of the z-axis and the negative direction of the z-axis).

Figure 20:
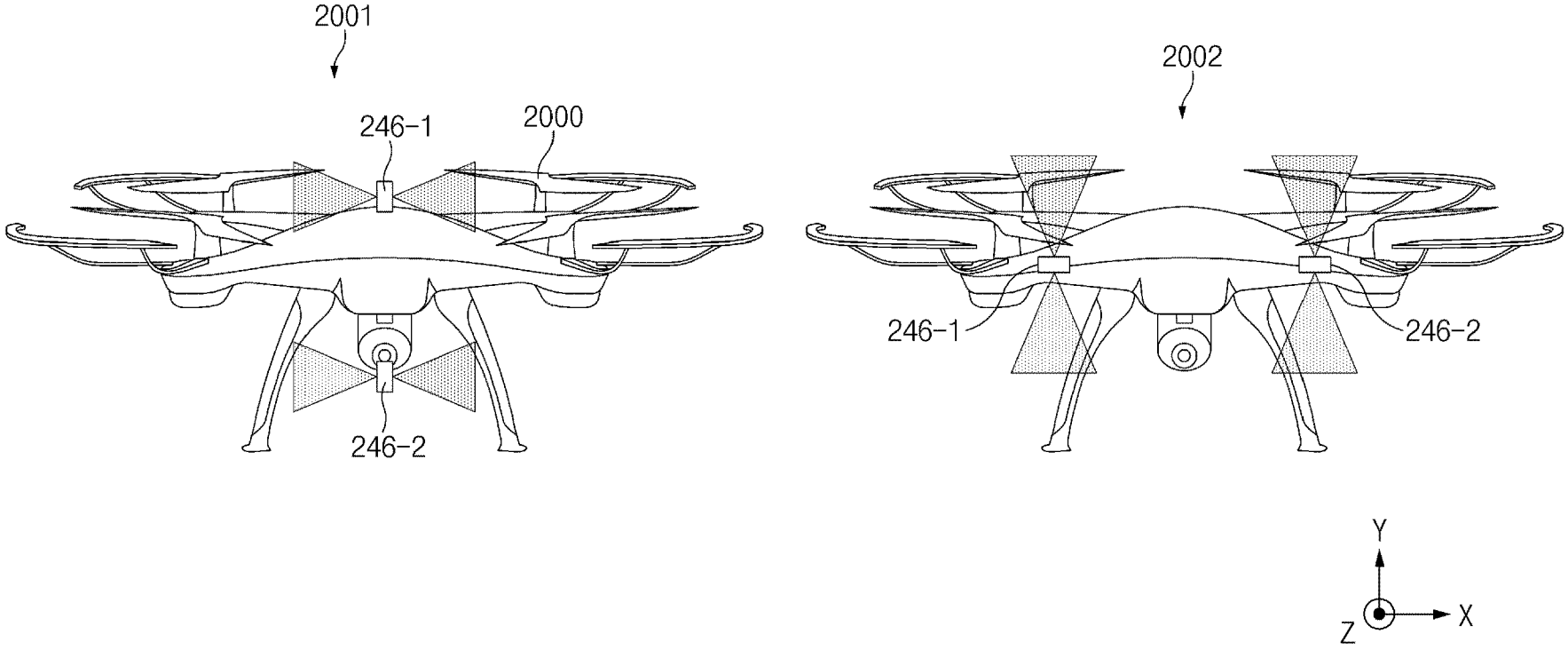
FIG. 20 illustrates an example of a radiation pattern of an antenna module disposed at a flying device according to an embodiment of the disclosure.

FIG. 20 illustrates an example of a radiation pattern of the third antenna module 246 disposed at a flying device 2000 according to an embodiment of the disclosure.

Referring to FIG. 20, the flying device 2000 may include at least one of the components of the electronic device 101 of FIG. 1. According to an embodiment, for the flying device 2000 to perform wireless communication in flight, at least one third antenna module 246 may be disposed on at least one surface of the flying device 2000 or within the flying device 2000. The number of third antenna modules (e.g., 246-1 and 246-2) illustrated in FIG. 20 and placement directions and locations of the third antenna modules are only one example and are not limited to the example illustrated in FIG. 20. For example, referring to reference numeral 2001, the plurality of third antenna modules 246-1 and 246-2 may be disposed at the flying device 2000 in a longitudinal direction (e.g., a direction substantially parallel to the zy-plane) such that the flying device 2000 is capable of performing wireless communication in a lateral direction (e.g., the positive direction of the x-axis and/or the negative direction of the x-axis). For another example, referring to reference numeral 2002, the plurality of third antenna modules 246-1 and 246-2 may be disposed at the flying device 2000 in a transverse direction (e.g., a direction substantially parallel to the xz-plane) such that the flying device 2000 is capable of performing wireless communication in a vertical direction (e.g., the positive direction of the y-axis and/or the negative direction of the y-axis).

As described above, an electronic device (e.g., 101 of FIG. 1) according to an embodiment may include a housing (e.g., 1510 of FIG. 15A) that includes a first plate, a second plate facing away from the first plate, and a side member surrounding a space between the first plate and the second plate, the side member being coupled to the second plate or integrally formed with the second plate, a printed circuit board (e.g., 510 of FIG. 5A) that is disposed in the space and includes a first conductive layer (e.g., 501 of FIG. 5A), a second conductive layer (e.g., 502 of FIG. 5A), a third conductive layer (e.g., 503 of FIG. 5A), and a ground, and an antenna structure (e.g., 500 of FIG. 5A) that is disposed in the space. The antenna structure may include a first conductive pattern (e.g., 560 of FIG. 5A) that is formed at the first conductive layer and is electrically connected with a first feeding line (e.g., 542 of FIG. 5A), a second conductive pattern (e.g., 570 of FIG. 5A) that is formed at the second conductive layer interposed between the first conductive layer and the third conductive layer and is electrically connected with the ground, and a third conductive pattern (e.g., 580 of FIG. 5A) that is formed at the third conductive layer and is electrically connected with a second feeding line. The first conductive pattern may include a first conductive line (e.g., 562 of FIG. 5A) that is extended in a first direction parallel to the first conductive layer, and a first radiation part (e.g., 564 of FIG. 5A) that is extended from the first conductive line in a second direction making a first angle belonging to a range from 0 degree to −90 degrees with the first direction. The third conductive pattern may include a second conductive line (e.g., 582 of FIG. 5A) that is extended in the first direction, and a second radiation part (e.g., 584 of FIG. 5A) that is extended from the second conductive line in a third direction making a second angle belonging to a range from 0 degree to +90 degrees with the first direction. The second conductive pattern may include a portion (e.g., 572 of FIG. 5A) that is electrically connected with the ground, a third conductive line (e.g., 573 of FIG. 5A) that is extended from the portion in the first direction, a third radiation part (e.g., 574 of FIG. 5A) that is extended from the third conductive line in a fourth direction facing away from the second direction, a fourth conductive line (e.g., 574 of FIG. 5A) that is spaced from the third conductive line and is extended from the portion in the first direction, and a fourth radiation part (e.g., 576 of FIG. 5A) that is extended from the fourth conductive line in a fifth direction facing away from the third direction.

According to an embodiment, the electronic device may further include a wireless communication circuit (e.g., 452 of FIG. 2) electrically connected with the first feeding line and the second feeding line, and the wireless communication circuit may radiate a signal in a specified frequency band, which has a first polarization direction, through the first radiation part and the third radiation part and may radiate a signal in the specified frequency band, which has a second polarization direction substantially perpendicular to the first polarization direction, through the second radiation part and the fourth radiation part.

According to an embodiment, the wireless communication circuit may include an RFIC.

According to an embodiment, the antenna structure and the RFIC may constitute an antenna module.

According to an embodiment, the electronic device may further include a plurality of vias (e.g., 590 of FIG. 5A) surrounding the first feeding line and the second feeding line.

According to an embodiment, a sum of lengths of the first radiation part and the third radiation part and a sum of lengths of the second radiation part and the fourth radiation part correspond to one half of a length of a wavelength corresponding to the specified frequency band.

According to an embodiment, the first angle may correspond to −45 degrees, and the second angle may correspond to +45 degrees.

According to an embodiment, the third conductive line and the fourth conductive line may form a slit (e.g., 577 of FIG. 6B) having a specified interval.

According to an embodiment, the electronic device may further include a first conductive region (e.g., 1321-1 or 1321-2 of FIG. 13) that is extended from the ground on opposite sides of the antenna structure in the first direction and is electrically connected with at least one of an integrated circuit (IC) device or a lumped element of the electronic device.

According to an embodiment, the electronic device may further include a second conductive region (e.g., 1341 of FIG. 13) that is extended from the ground, surrounds the antenna structure, and is electrically connected with at least one of an IC device or a lumped element of the electronic device.

An electronic device (e.g., 101 of FIG. 1) according to an embodiment of the disclosure may include a housing (e.g., 1510 of FIG. 15A) that includes a first plate, a second plate facing away from the first plate, and a side member surrounding a space between the first plate and the second plate, the side member being coupled to the second plate or integrally formed with the second plate, a printed circuit board (e.g., 510 of FIG. 9A) that is disposed in the space and includes a first conductive layer (e.g., 501 of FIG. 9A), a second conductive layer (e.g., 502 of FIG. 9A), a third conductive layer (e.g., 503 of FIG. 9A), and a ground, and an antenna structure (e.g., 900 of FIG. 9A) that is disposed in the space. The antenna structure may include a first conductive pattern (e.g., 940 of FIG. 9A) that is formed at the first conductive layer and is electrically connected with a first feeding line (e.g., 922 of FIG. 9A), a second conductive pattern (e.g., 950 of FIG. 9A) that is formed at the first conductive layer and is electrically connected with a second feeding line (e.g., 924 of FIG. 9A), a third conductive pattern (e.g., 960 of FIG. 9A) that is formed at the second conductive layer interposed between the first conductive layer and the third conductive layer and is electrically connected with the ground, a fourth conductive pattern (e.g., 970 of FIG. 9A) that is formed at the third conductive layer and is electrically connected with a third feeding line (e.g., 926 of FIG. 9A), and a fifth conductive pattern (e.g., 980 of FIG. 9A) that is formed at the third conductive layer and is electrically connected with a fourth feeding line (e.g., 928 of FIG. 9A). The first conductive pattern may include a first conductive line (e.g., 942 of FIG. 9A) that is extended in a first direction parallel to the first conductive layer, and a first radiation part (e.g., 944 of FIG. 9A) that is extended from the first conductive line in a second direction making a first angle belonging to a range from 0 degree to −90 degrees with the first direction. The second conductive pattern may include a second conductive line (e.g., 952 of FIG. 9A) that is extended substantially in parallel with the first conductive layer, and a second radiation part (e.g., 954 of FIG. 9A) that is extended from the second conductive line in a third direction making a second angle belonging to a range from −90 degrees to −180 degrees with the first direction. The third conductive pattern may be extended in the first direction. The fourth conductive pattern may include a third conductive line (e.g., 972 of FIG. 9A) that is extended in the first direction, and a third radiation part (e.g., 974 of FIG. 9A) that is extended from the third conductive line in a direction facing away from the second direction. The fifth conductive pattern may include a fourth conductive line (e.g., 982 of FIG. 9A) that is extended in the first direction, and a fourth radiation part (e.g., 984 of FIG. 9A) that is extended from the fourth conductive line in a direction facing away from the third direction.

According to an embodiment, the electronic device may further include a wireless communication circuit electrically connected with the first feeding line and the second feeding line, and the wireless communication circuit may radiate a signal in a specified frequency band, which has a first polarization direction, through the first radiation part and the third radiation part and may radiate a signal in the specified frequency band, which has a second polarization direction substantially perpendicular to the first polarization direction, through the second radiation part and the fourth radiation part.

According to an embodiment, the wireless communication circuit may include an RFIC (e.g., 452 of FIG. 4).

According to an embodiment, the antenna structure and the RFIC may constitute an antenna module.

According to an embodiment, the electronic device may further include a plurality of vias (e.g., 990 of FIG. 9A) surrounding the first feeding line, the second feeding line, the third feeding line, and the fourth feeding line.

According to an embodiment, a sum of lengths of the first radiation part and the third radiation part and a sum of lengths of the second radiation part and the fourth radiation part correspond to one half of a length of a wavelength corresponding to the specified frequency band.

According to an embodiment, the first angle may correspond to −45 degrees, and the second angle may correspond to −135 degrees.

According to an embodiment, the third conductive pattern may form a slit structure (e.g., 977 of FIG. 10B).

According to an embodiment, the electronic device may further include a first conductive region (e.g., 1321-1 or 1321-2 of FIG. 13) that is extended from the ground on opposite sides of the antenna structure in the first direction and is electrically connected with at least one of an integrated circuit (IC) device or a lumped element of the electronic device.

According to an embodiment, the electronic device may further include a second conductive region (e.g., 1341 of FIG. 13) that is extended from the ground, surrounds the antenna structure, and is electrically connected with at least one of an IC device or a lumped element of the electronic device.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to embodiments of the disclosure, an antenna module may include a dipole antenna having a dual polarization characteristic.

According to embodiments of the disclosure, an electronic device including an antenna module may include an antenna structure that radiates signals in opposite directions and has a dual polarization characteristic.

Besides, a variety of effects directly or indirectly understood through this disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including:

a first plate;

a second plate facing away from the first plate, and a side member surrounding a space between the first plate and the second plate, the side member being coupled to the second plate or integrally formed with the second plate;

a printed circuit board disposed in the space and including:

a first conductive layer, a second conductive layer, a third conductive layer, and a ground; and an antenna structure disposed in the space, wherein the antenna structure includes:

a first conductive pattern formed at the first conductive layer and electrically connected with a first feeding line, a second conductive pattern formed at the second conductive layer interposed between the first conductive layer and the third conductive layer and electrically connected with the ground, and a third conductive pattern formed at the third conductive layer and electrically connected with a second feeding line, wherein the first conductive pattern includes:

a first conductive line extended in a first direction parallel to the first conductive layer, and a first radiation part extended from the first conductive line in a second direction making a first angle between 0 to −90 degrees with the first direction, wherein the third conductive pattern includes:

a second conductive line extended in the first direction, and a second radiation part extended from the second conductive line in a third direction making a second angle between 0 to +90 degrees with the first direction, and wherein the second conductive pattern includes:

a portion electrically connected with the ground, a third conductive line extended from the portion in the first direction, a third radiation part extended from the third conductive line in a fourth direction facing away from the second direction, a fourth conductive line spaced from the third conductive line and extended from the portion in the first direction, and a fourth radiation part extended from the fourth conductive line in a fifth direction facing away from the third direction.

2. The electronic device of claim 1, further comprising:

a wireless communication circuit electrically connected with the first feeding line and the second feeding line, wherein the wireless communication circuit is configured to:

radiate a signal in a specified frequency band, which has a first polarization direction, through the first radiation part and the third radiation part, and radiate a signal in the specified frequency band, which has a second polarization direction substantially perpendicular to the first polarization direction, through the second radiation part and the fourth radiation part.

3. The electronic device of claim 2, wherein the wireless communication circuit includes a radio frequency integrated circuit (RFIC).

4. The electronic device of claim 3, wherein the antenna structure and the RFIC constitute an antenna module.

5. The electronic device of claim 2, further comprising:

a plurality of vias surrounding the first feeding line and the second feeding line.

6. The electronic device of claim 1, wherein a sum of lengths of the first radiation part and the third radiation part and a sum of lengths of the second radiation part and the fourth radiation part correspond to one half of a length of a wavelength corresponding to a specified frequency band.

7. The electronic device of claim 1, wherein the first angle comprises −45 degrees, and wherein the second angle comprises +45 degrees.

8. The electronic device of claim 1, wherein the third conductive line and the fourth conductive line form a slit having a specified interval.

9. The electronic device of claim 1, further comprising:

a first conductive region extended from the ground on opposite sides of the antenna structure in the first direction and electrically connected with at least one of an integrated circuit (IC) device or a lumped element of the electronic device.

10. The electronic device of claim 1, further comprising:

a second conductive region extended from the ground, surrounding the antenna structure, and electrically connected with at least one of an IC device or a lumped element of the electronic device.

11. An electronic device comprising:

a housing including:

a first plate, a second plate facing away from the first plate, and a side member surrounding a space between the first plate and the second plate, the side member being coupled to the second plate or integrally formed with the second plate;

a printed circuit board disposed in the space and including:

a first conductive layer, a second conductive layer, a third conductive layer, and a ground; and an antenna structure disposed in the space, wherein the antenna structure includes:

a first conductive pattern formed at the first conductive layer and electrically connected with a first feeding line, a second conductive pattern formed at the first conductive layer and electrically connected with a second feeding line, a third conductive pattern formed at the second conductive layer interposed between the first conductive layer and the third conductive layer and electrically connected with the ground, a fourth conductive pattern formed at the third conductive layer and electrically connected with a third feeding line, and a fifth conductive pattern formed at the third conductive layer and electrically connected with a fourth feeding line, wherein the first conductive pattern includes:

a first conductive line extended in a first direction parallel to the first conductive layer, and a first radiation part extended from the first conductive line in a second direction making a first angle between 0 to −90 degrees with the first direction, wherein the second conductive pattern includes:

a second conductive line extended substantially in parallel with the first conductive layer, and a second radiation part extended from the second conductive line in a third direction making a second angle between −90 to −180 degrees with the first direction, wherein the third conductive pattern is extended in the first direction, wherein the fourth conductive pattern includes:

a third conductive line extended in the first direction, and a third radiation part extended from the third conductive line in a direction facing away from the second direction, and wherein the fifth conductive pattern includes:

a fourth conductive line extended in the first direction, and a fourth radiation part extended from the fourth conductive line in a direction facing away from the third direction.

12. The electronic device of claim 11, further comprising:

a wireless communication circuit electrically connected with the first feeding line and the second feeding line, wherein the wireless communication circuit is configured to:

radiate a signal in a specified frequency band, which has a first polarization direction, through the first radiation part and the third radiation part, and radiate a signal in the specified frequency band, which has a second polarization direction substantially perpendicular to the first polarization direction, through the second radiation part and the fourth radiation part.

13. The electronic device of claim 12, wherein the wireless communication circuit includes a radio frequency integrated circuit (RFIC).

14. The electronic device of claim 13, wherein the antenna structure and the RFIC constitute an antenna module.

15. The electronic device of claim 12, further comprising:

a plurality of vias surrounding the first feeding line, the second feeding line, the third feeding line, and the fourth feeding line.

16. The electronic device of claim 11, wherein a sum of lengths of the first radiation part and the third radiation part and a sum of lengths of the second radiation part and the fourth radiation part correspond to one half of a length of a wavelength corresponding to a specified frequency band.

17. The electronic device of claim 11, wherein the first angle comprises −45 degrees, and wherein the second angle comprises −135 degrees.

18. The electronic device of claim 11, wherein the third conductive pattern forms a slit structure.

19. The electronic device of claim 11, further comprising:

a first conductive region extended from the ground on opposite sides of the antenna structure in the first direction and electrically connected with at least one of an integrated circuit (IC) device or a lumped element of the electronic device.

20. The electronic device of claim 11, further comprising:

a second conductive region extended from the ground, surrounding the antenna structure, and electrically connected with at least one of an IC device or a lumped element of the electronic device.

* * * * *